US007979929B2

(12) United States Patent
Vogel et al.

(10) Patent No.: US 7,979,929 B2
(45) Date of Patent: Jul. 19, 2011

(54) QUICK CHANGE MOUNTING SYSTEM FOR A FAUCET

(75) Inventors: John David Vogel, Columbus, IN (US); Ryan Anthony Reeder, Carmel, IN (US)

(73) Assignee: Masco Corporation of Indiana, Indianapolis, IN (US)

( * ) Notice: Subject to any disclaimer, the term of this patent is extended or adjusted under 35 U.S.C. 154(b) by 1526 days.

(21) Appl. No.: 11/374,688

(22) Filed: Mar. 14, 2006

(65) Prior Publication Data

US 2006/0200904 A1 Sep. 14, 2006

Related U.S. Application Data

(60) Provisional application No. 60/661,949, filed on Mar. 14, 2005.

(51) Int. Cl.
*E03C 1/042* (2006.01)

(52) U.S. Cl. ..... 4/695

(58) Field of Classification Search ..... 4/675–678, 4/695, 696; 137/359, 360, 801; 239/200, 239/600

See application file for complete search history.

(56) References Cited

U.S. PATENT DOCUMENTS

| | | | |
|---|---|---|---|
| 1,592,353 | A | 7/1926 | Gade |
| 2,173,064 | A | 9/1939 | Judell |
| 2,591,991 | A | 4/1952 | Young |
| 2,848,721 | A | 8/1956 | Fredrickson |
| 3,010,474 | A | 11/1961 | Moen |
| 3,012,251 | A | 12/1961 | Fife |
| 3,035,276 | A | 5/1962 | Hanson |
| 3,155,115 | A | 11/1964 | Ziegler |
| 3,229,710 | A | 1/1966 | Keller, III |
| 3,427,049 | A | 2/1969 | Politz |
| 3,448,768 | A | 6/1969 | Keller, III |
| 3,495,616 | A | 2/1970 | Esposito |
| 3,561,485 | A | 2/1971 | Klingler |
| 3,600,723 | A | 8/1971 | Mongerson et al. |
| 3,609,774 | A | 10/1971 | Allgood |
| 3,645,493 | A | 2/1972 | Manoogian et al. |
| 3,790,966 | A | 2/1974 | Keane |
| 3,796,380 | A | 3/1974 | Johnson et al. |
| 3,807,453 | A | 4/1974 | Dom et al. |
| 3,911,946 | A | 10/1975 | Humpert et al. |
| 3,998,240 | A | 12/1976 | Liautaud |
| 4,026,328 | A | 5/1977 | Nelson |
| 4,064,900 | A | 12/1977 | Schmitt |
| 4,186,761 | A | 2/1980 | Guarnieri |
| RE30,559 | E | 3/1981 | Schmitt |
| 4,290,445 | A | 9/1981 | Turner |
| 4,328,830 | A | 5/1982 | Greer |
| 4,337,795 | A | 7/1982 | Argyris et al. |
| 4,356,574 | A | 11/1982 | Johnson |
| 4,387,738 | A | 6/1983 | Bisonaya et al. |
| 4,446,885 | A | 5/1984 | Nolden |
| 4,458,839 | A | 7/1984 | MacDonald |
| 4,513,769 | A | 4/1985 | Purcell |

(Continued)

FOREIGN PATENT DOCUMENTS

| | | |
|---|---|---|
| CH | 245633 | 11/1947 |

(Continued)

*Primary Examiner* — Huyen Le
(74) *Attorney, Agent, or Firm* — Baker & Daniels LLP

(57) ABSTRACT

A faucet assembly including a mounting base and an upper faucet assembly. A coupler releasably couples the upper faucet assembly to the mounting base.

24 Claims, 22 Drawing Sheets

U.S. PATENT DOCUMENTS 4,552,171 A 11/1985 Farrell et al.
4,635,673 A 1/1987 Gerdes
4,649,958 A 3/1987 Purcell
4,671,316 A 6/1987 Botnick
4,678,002 A 7/1987 Valley
4,700,928 A 10/1987 Marty
4,706,702 A 11/1987 Grasseschi
4,760,861 A 8/1988 Botnick
4,762,143 A 8/1988 Botnick
4,762,273 A 8/1988 Gregory et al.
4,771,485 A 9/1988 Traylor
4,827,538 A 5/1989 Heimann et al.
4,848,395 A 7/1989 Krippendorf
4,852,192 A 8/1989 Viegener
4,856,121 A 8/1989 Traylor
4,903,725 A 2/1990 Ko
4,911,335 A 3/1990 Stofle et al.
4,966,186 A 10/1990 Rodstein
4,998,555 A 3/1991 Barhydt, Sr. et al.
5,010,922 A 4/1991 Agresta
5,020,569 A 6/1991 Agresta
5,027,851 A 7/1991 Drees et al.
5,073,991 A 12/1991 Marty
5,090,062 A 2/1992 Hochstrasser
5,095,554 A 3/1992 Gloor
5,127,427 A 7/1992 Kajpust et al.
5,127,438 A 7/1992 Williams
5,131,428 A 7/1992 Bory
5,148,832 A 9/1992 Lin
5,165,121 A 11/1992 McTargett et al.
5,232,008 A 8/1993 Jeffress et al.
5,275,199 A 1/1994 Howell
5,349,987 A 9/1994 Shieh
5,361,431 A 11/1994 Freier et al.
5,375,272 A 12/1994 Mikol
5,388,287 A 2/1995 Tischler et al.
5,465,749 A 11/1995 Sauter et al.
5,467,799 A 11/1995 Buccicone et al.
5,515,882 A 5/1996 Hennis
5,518,016 A 5/1996 Sharwark
5,535,776 A 7/1996 Kingman
5,558,128 A 9/1996 Pawelzik et al.
5,566,707 A 10/1996 Ching et al.
5,642,755 A 7/1997 Mark et al.
5,660,203 A 8/1997 Gnauert et al.
5,669,417 A 9/1997 Lian-Jie
5,685,341 A 11/1997 Chrysler et al.
5,687,952 A 11/1997 Arnold et al.
5,725,008 A 3/1998 Johnson
5,746,244 A 5/1998 Woolley, Sr. et al.
5,758,688 A 6/1998 Hamanaka et al.
5,797,151 A 8/1998 Ko
5,803,120 A 9/1998 Bertoli
5,813,431 A 9/1998 Cool et al.
5,822,811 A 10/1998 Ko
5,845,345 A 12/1998 Ko
5,865,211 A 2/1999 Thomas
5,865,473 A 2/1999 Semchuck et al.
5,884,662 A 3/1999 Ko
5,894,613 A 4/1999 Fenn
5,918,855 A 7/1999 Hamanaka et al.
5,924,451 A 7/1999 Kuo
5,946,746 A * 9/1999 Bloom ..... 4/675
5,950,663 A 9/1999 Bloomfield
5,960,490 A 10/1999 Pitsch
5,979,489 A 11/1999 Pitsch
5,983,917 A 11/1999 Thomas
6,006,784 A 12/1999 Tsutsui et al.
6,014,985 A 1/2000 Warshawsky
6,023,796 A 2/2000 Pitsch
6,062,251 A 5/2000 Pitsch
6,073,972 A 6/2000 Rivera
6,082,407 A 7/2000 Paterson et al.
6,085,784 A 7/2000 Bloom et al.
6,123,106 A 9/2000 Benstead
6,125,875 A 10/2000 Dempsey et al.
6,138,296 A * 10/2000 Baker ..... 4/678
6,161,230 A 12/2000 Pitsch
6,170,098 B1 1/2001 Pitsch
6,189,569 B1 2/2001 Calhoun
6,195,818 B1 3/2001 Rodstein et al.
6,202,686 B1 3/2001 Pitsch et al.
6,202,980 B1 3/2001 Vincent et al.
6,209,153 B1 4/2001 Segien, Jr.
6,220,278 B1 4/2001 Sauter et al.
6,220,279 B1 4/2001 Segien
6,256,810 B1 7/2001 Baker
6,267,136 B1 7/2001 Johnson
6,273,138 B1 8/2001 Yoney
6,273,394 B1 8/2001 Vincent et al.
6,301,728 B1 10/2001 Pilatowicz et al.
6,302,131 B1 10/2001 Pitsch
6,314,593 B1 11/2001 Mantel
6,328,059 B1 12/2001 Testori et al.
6,334,226 B1 1/2002 Tokunaga et al.
6,360,770 B1 3/2002 Buchner et al.
6,360,774 B1 3/2002 Becker et al.
6,370,712 B1 4/2002 Burns et al.
6,378,912 B1 4/2002 Condon et al.
6,385,798 B1 5/2002 Burns et al.
6,405,749 B1 6/2002 Bloom et al.
6,421,849 B1 7/2002 Gray
6,422,520 B1 7/2002 Hand
6,434,765 B1 8/2002 Burns et al.
6,438,771 B1 8/2002 Donath, Jr. et al.
6,457,191 B2 10/2002 Brandebusemeyer et al.
6,484,330 B2 11/2002 Gray et al.
6,491,058 B1 12/2002 Wang
6,571,407 B1 6/2003 Skarie
6,619,320 B2 9/2003 Parsons
6,631,730 B1 10/2003 Bloom et al.
6,684,906 B2 * 2/2004 Burns et al. ..... 137/606
6,718,568 B1 4/2004 Hensley
6,725,472 B2 * 4/2004 Gray et al. ..... 4/684
6,757,921 B2 7/2004 Esche
6,792,629 B2 9/2004 Nelson et al.
6,807,692 B2 10/2004 Tsutsui et al.
6,868,564 B2 3/2005 Ginter et al.
6,874,527 B2 4/2005 Meeder
6,874,535 B2 4/2005 Parsons et al.
6,912,742 B1 7/2005 Wang
6,918,400 B2 7/2005 Buchner et al.
7,017,600 B2 3/2006 Klein
7,055,545 B2 6/2006 Mascari et al.
7,175,158 B2 2/2007 Thomas
2001/0011389 A1 8/2001 Philipps-Liebich et al.
2001/0044955 A1 11/2001 Brandebusemeyer
2002/0083520 A1 7/2002 Osborne-Kirby
2002/0124309 A1 9/2002 Donath, Jr. et al.
2002/0185182 A1 12/2002 Wang
2002/0189674 A1 12/2002 Meeder
2003/0204906 A1 11/2003 Tsutsui et al.
2003/0221254 A1 12/2003 McNerney et al.
2004/0034924 A1 2/2004 Underbrink et al.
2004/0060109 A1 4/2004 Hensley
2004/0094202 A1 5/2004 Kawolics et al.
2004/0123910 A1 7/2004 Yardley
2004/0143900 A1 7/2004 Nelson et al.
2004/0154673 A1 8/2004 Mascari et al.
2004/0179351 A1 9/2004 Patterson
2004/0200987 A1 10/2004 Houghton
2004/0221899 A1 11/2004 Parsons et al.
2005/0022299 A1 2/2005 Brown et al.
2005/0199843 A1 9/2005 Jost et al.
2005/0242198 A1 11/2005 Kempf et al.
2005/0242199 A1 11/2005 Kempf et al.
2005/0251907 A1 11/2005 Mintz et al.
2006/0042006 A1 3/2006 Thomas
2006/0076056 A1 4/2006 Schmitt et al.
2007/0044232 A1 3/2007 McNerney et al.

FOREIGN PATENT DOCUMENTS

CH 275914 6/1951
CN 1278584 1/2001
CN 1278585 1/2001
CN 1278586 1/2001
CN 1278588 1/2001

| | | | |
|---|---|---|---|
| DE | 100 22 350 | A1 | 11/2001 |
| EP | 0 808 952 | B1 | 9/2003 |
| GB | 371616 | | 5/1931 |
| JP | 2006/328812 | | 12/2006 |
| WO | WO 2005/056937 | | 6/2005 |
| WO | WO 2005/118966 | | 12/2005 |
| WO | WO 2007/027340 | | 3/2007 |

* cited by examiner

QUICK CHANGE MOUNTING SYSTEM FOR A FAUCET

CROSS-REFERENCE TO RELATED APPLICATION

This application claims the benefit of U.S. Provisional Application Ser. No. 60/661,949, filed Mar. 14, 2005, the disclosure of which is expressly incorporated by reference herein.

U.S. patent application Ser. No. 10/918,939, filed Aug. 16, 2004, U.S. patent application Ser. No. 11/214,241, filed Aug. 29, 2005, and U.S. Pat. No. 7,003,818, issued Feb. 28, 2006 are expressly incorporated by reference herein.

BACKGROUND AND SUMMARY OF THE INVENTION

The present invention relates to a mounting system for faucets in which the faucet may be mounted from the top of the mounting deck, such as a countertop or sink.

The installation of a faucet onto a mounting deck is often a difficult and time-consuming task. At least some of the installation typically requires the installer to work in the cramped and dimly lit work area under the mounting deck. More particularly, faucets are typically attached to the mounting deck with threaded connections which must be made under and behind the sink basin wherein there is very little room to work.

As such, there is a need to provide a less cumbersome and complicated system of installing faucets or interchanging different faucet styles onto a mounting deck which can be done largely from the top of the countertop or sink. More particularly, a system is desired which would permit the installer to exchange different escutcheon styles, delivery spouts, and handle combinations quickly and easily without replacing the complete faucet assembly.

According to an illustrative embodiment of the present disclosure, a faucet assembly includes a mounting plate adapted to be removably coupled to a mounting deck, the mounting plate including a flange. An upper faucet assembly includes a bracket having a cam slot configured to slidably receive the flange of the mounting plate. A locking mechanism includes a lock bushing supported for movement relative to the mounting plate between lowered and raised positions, the lock bushing in the raised position configured to secure the upper faucet assembly by preventing sliding movement of the cam slot relative to the flange.

According to another illustrative embodiment of the present disclosure, a faucet assembly is configured to be mounted to a support defining an inner side and an outer side. The faucet assembly includes a body assembly including a delivery spout, a hot water inlet conduit having opposing first and second ends, the second end of the hot water inlet conduit being in fluid communication with the delivery spout, and a cold water inlet conduit having opposing first and second ends, the second end of the cold water inlet conduit being in fluid communication with the delivery spout. A hot water supply assembly includes a conduit and a quick release fluid coupling configured to releasably couple to the first end of the hot water inlet conduit. The hot water quick release coupling is supported for movement between a hidden position on the inner side of the support, and an exposed position on the outer side of the support. A cold water supply conduit assembly includes a conduit and a quick release fluid coupling configured to releasably couple to the first end of the cold water inlet conduit. The cold water quick release coupling is supported for movement between a hidden position on the inner side of the support, and an exposed position on the outer side of the support. The body assembly is configured to be mechanically coupled to and uncoupled from the support entirely from the outer side of the support surface. The body assembly is further configured to be fluidly coupled to and uncoupled from the hot water quick release fluid coupling and the cold water quick release fluid coupling from either the inner side or the outer side of the support.

According to yet another illustrative embodiment of the present disclosure, a faucet assembly is configured to be mounted to a support having a lower surface and an upper surface. The faucet includes an upper faucet assembly including a delivery spout, a lift rod, and a lift rod passageway for receiving the lift rod. A locking device is configured to secure the upper faucet assembly relative to the support. A drain assembly includes a plug releasably coupled to the lift rod and is configured to move in response to movement of the lift rod. The lift rod is configured to be coupled to and uncoupled from the drain assembly entirely from above the support.

According to another illustrative embodiment of the present disclosure, a faucet assembly includes an upper faucet assembly configured to be supported by a mounting deck. A first locking device is configured to restrain the upper faucet assembly from movement perpendicular to mounting deck. A second locking device is configured to restrain the upper faucet assembly from movement parallel to the mounting deck.

According to a further illustrative embodiment of the present disclosure, a method of installing a faucet includes the steps of placing the upper faucet assembly on top of a mounting deck, and securing the upper faucet assembly relative to the mounting deck entirely from above the mounting deck. The method further includes the steps of inserting a lift rod into a lift rod passageway formed in the upper faucet assembly, and coupling the lift rod to a drain assembly entirely from above the mounting deck.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
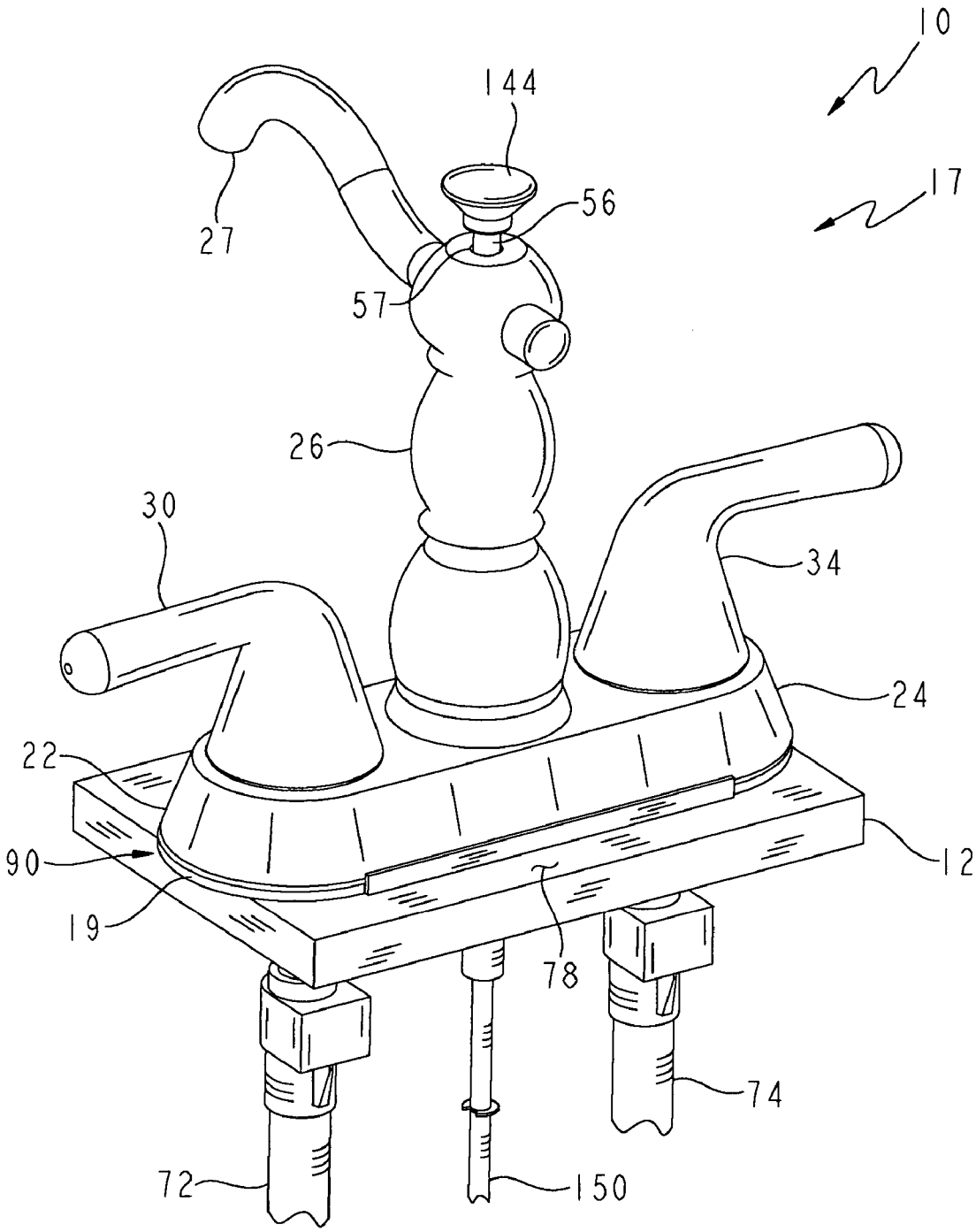
FIG. 1 is a perspective view of an illustrative embodiment faucet assembly coupled to a portion of a mounting deck.
Figure 2:
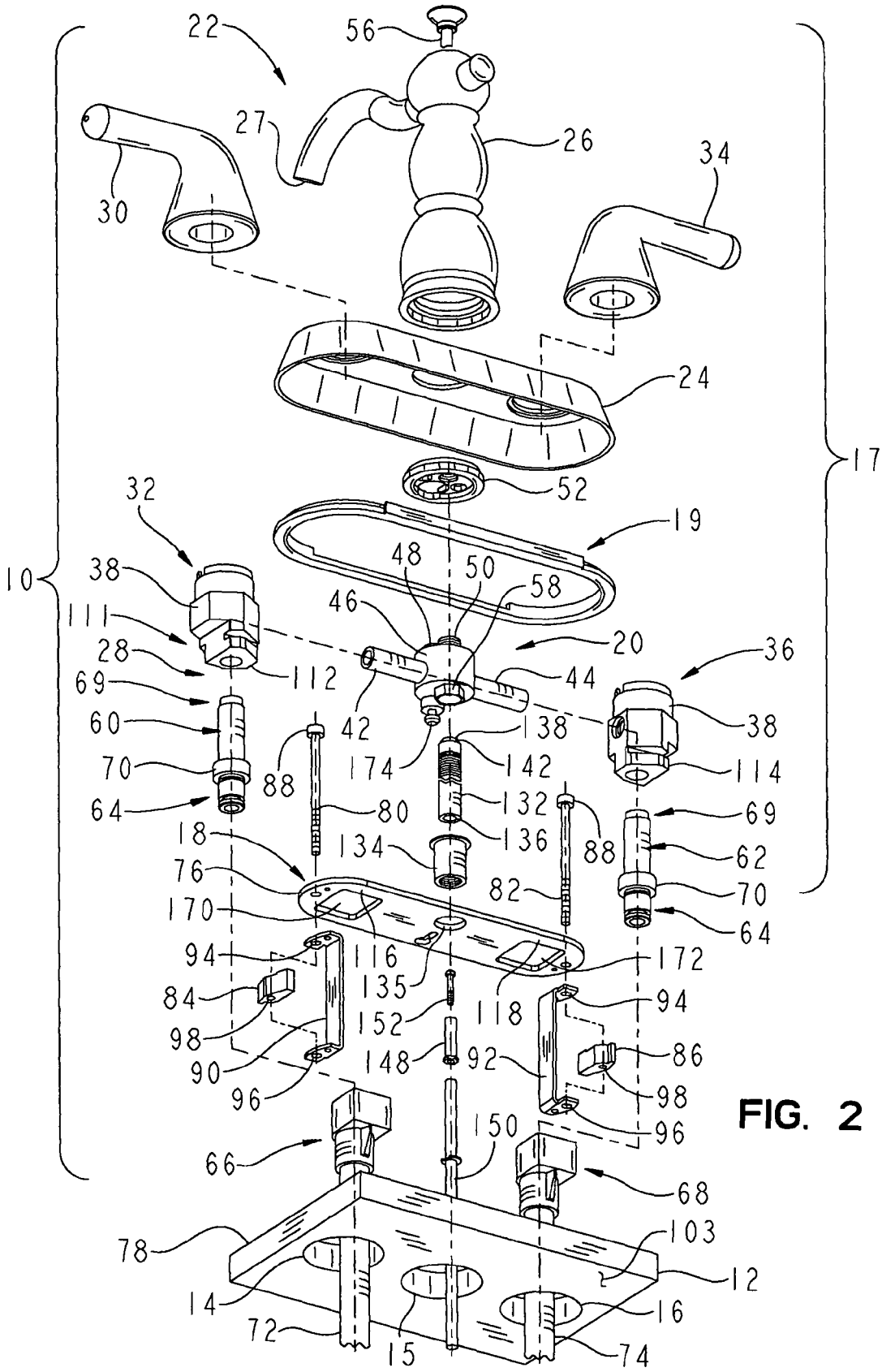
FIG. 2 is an exploded perspective view of the faucet assembly of FIG. 1.

Referring initially to FIGS. 1 and 2, a faucet assembly 10 according to an illustrative embodiment of the present invention is shown in conjunction with a portion of a support or mounting deck 12 to which it is coupled. The mounting deck 12 typically comprises a countertop or sink ledge and includes access openings 14, 15, and 16 (FIG. 2). The faucet assembly 10 includes an upper faucet or body assembly 17, a mounting base 18, and a gasket 19. The upper faucet assembly 17 includes a tubular waterway 20, and a faucet body housing or escutcheon 22 with a base 24 and a spout 26. The spout 26 includes a water outlet or discharge head 27 for delivering water therefrom. As detailed below, a coupler 28 releasably couples the upper faucet assembly 17 to the mounting base 18.

In the embodiment illustrated in FIGS. 1 and 2 for a two-handle faucet, a cold water control handle 30 is coupled to a cold water valve 32, and a hot water control handle 34 is coupled to a hot water valve 36. The handles 30 and 32 are coupled to the respective valves 32 and 36 in a conventional manner, for example, through the use of a set screw (not shown). Each valve 32 and 36 includes an outer housing 38 which receives a rotatable valving member (not shown) of conventional design for controlling the flow of water passing through the valve 32 and 36 in response to movement of the handle 30 and 34, respectively. The valves 32 and 36 may be of conventional design, and illustratively of the type detailed in U.S. Pat. Nos. 3,645,493 or 4,700,928, both of which are expressly incorporated by reference herein. The waterway 20 includes two tubular arms 42 and 44 extending from a hub 46 to the valves 32 and 36, respectively. An outlet 48 extends upwardly from the hub 46 and sealingly engages a tubular member (not shown) extending through the spout 26 to the outlet 27.

While the illustrative embodiment shows two handles 30 and 34 coupled to a pair of valves 32 and 36, it should be appreciated that the present invention may also be used with a faucet assembly including a single handle (not shown). Further, while the handles 30 and 34 in the illustrative embodiment comprise levers, supported for rotation by approximately 90 degrees, it should be appreciated that conventional knobs (not shown), supported for rotation by approximately 180 degrees, may be readily substituted therefor. Moreover, levers, knobs, or any other conventional operating handle may be utilized in connection with the faucet assembly 10.

Figure 3:
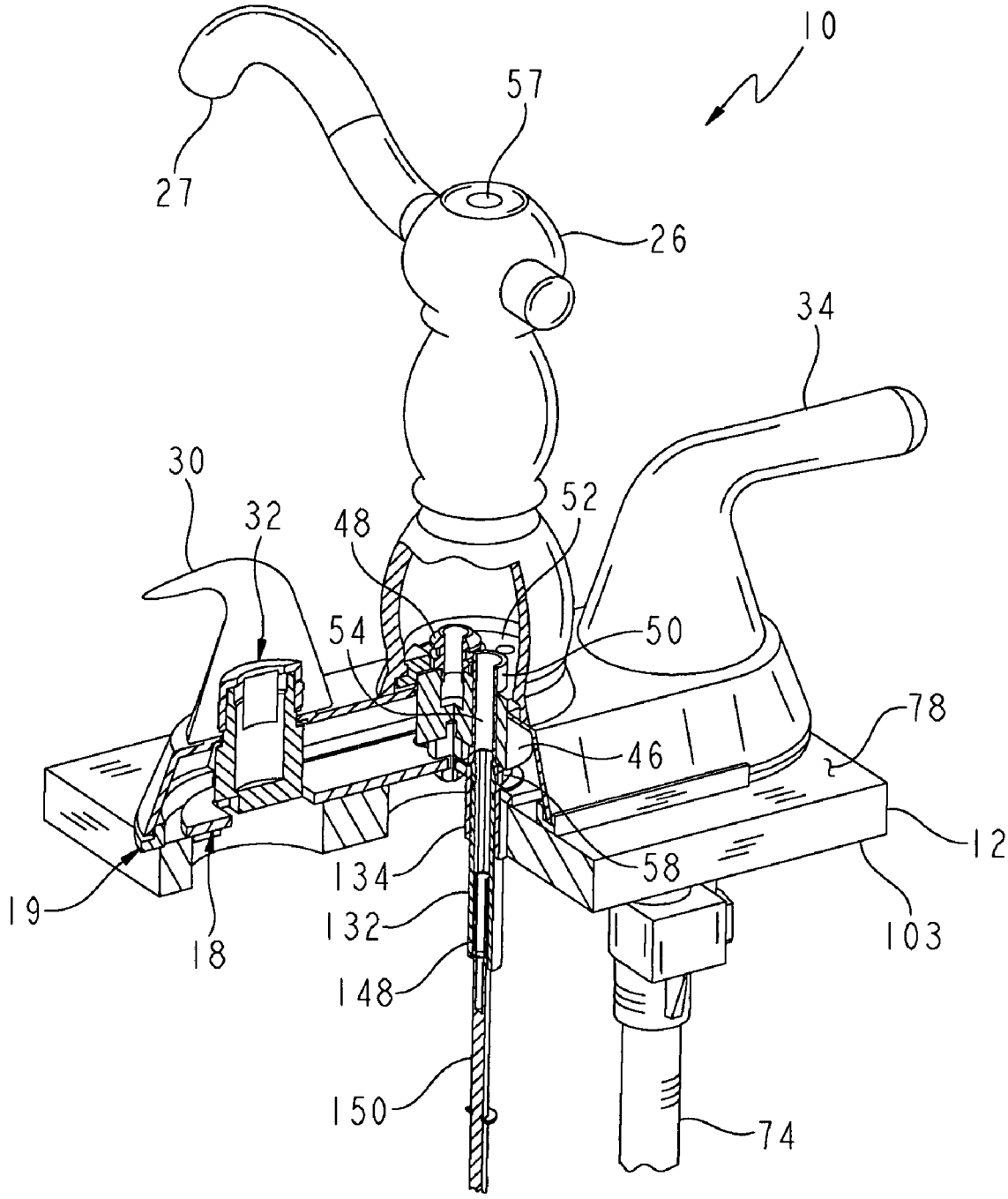
FIG. 3 is a perspective view similar to FIG. 1 with a partial cut-away thereof.

With reference to FIGS. 2 and 3, an externally threaded bushing 50 extends through an opening formed in the hub 46 and is configured to be threadably received within a coupling plate 52 fixed to a lower end of the spout 26. As such, the bushing 50 couples the spout 26 to the hub 46. The bushing 50 is cylindrical and defines a passageway 54 therethrough for receipt of an upper lift rod 56. The upper lift rod 56 is of conventional design and is received for sliding movement within an upper lift rod passageway 57 formed within the spout 26 and housing 22. A lower end of the bushing 50 includes a receiver 58 having a plurality of flats arranged in a hexagonal pattern to assist in coupling with a conventional securing tool, such as a wrench.

Figure 4:
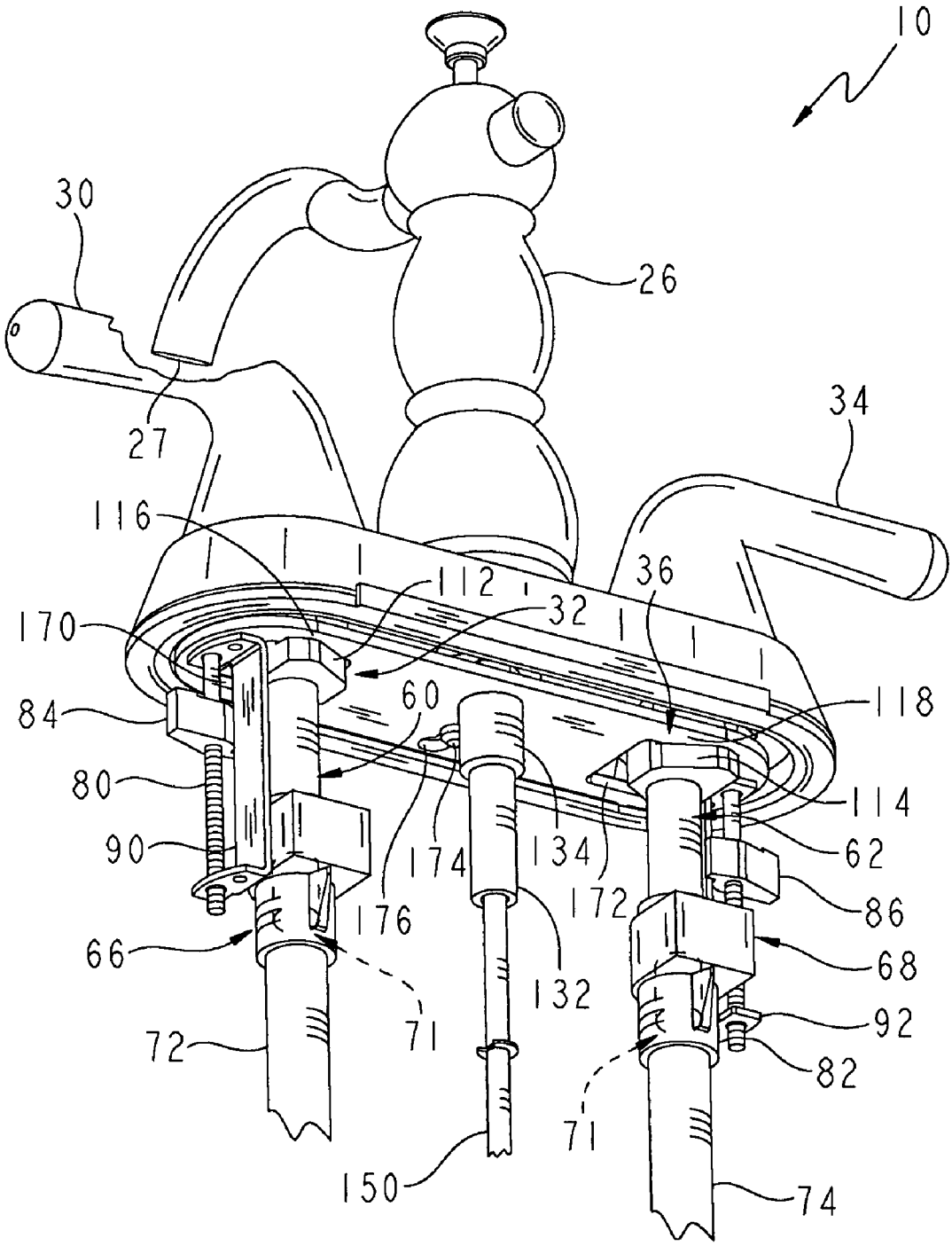
FIG. 4 is a bottom perspective view of the faucet assembly of FIG. 1, showing the mounting base.

With reference to FIGS. 2 and 4, a pair of inlet water conduits 60 and 62 extend downwardly from the valves 32 and 36. Each of the inlet water conduits 60 and 62 includes a first or connection end 64 configured to couple to a conventional quick release fluid coupling 66 and 68, respectively. Each inlet water conduit 60 and 62 also includes a second end 69 in fluid communication with the delivery spout 26 through the waterway 20. An annular stop ring 70 is supported by each conduit 60 and 62 adjacent the connection end 64 and is configured to provide a stop for engaging the respective fluid coupling 66 and 68. The fluid couplings 66 and 68 illustratively comprise a quick release coupling, such as PMC Series couplings available from Colder Products Company of St. Paul, Minn. Alternatively, the fluid couplings 66 and 68 may be of the type detailed in U.S. Pat. No. 6,672,628, which is expressly incorporated by reference herein.

In a further illustrative embodiment, the fluid couplings 66 and 68 may comprise conventional quick release check valves, wherein insertion of the connection end 64 within the coupling 66, 68 releases a spring biased valve 71 (FIG. 4) thereby allowing the flow of water. However, once the connection end 64 is removed, the valve 71 closes, thereby preventing water flow or leakage therethrough. Illustrative quick release check valves are shown in PCT International Publication No. WO 2005/118966, published Dec. 15, 2005, and U.S. patent application Ser. No. 11/214,241, filed Aug. 29, 2005, the disclosures of which are expressly incorporated by reference herein. The couplings 66 and 68 are coupled to conventional cold and hot water supply tubes 72 and 74 for carrying cold and hot water from conventional cold and hot water sources, respectively (not shown). Illustratively, the supply tubes 72 and 74 are formed of a flexible material to facilitate positioning of the fluid couplings 66 and 68 relative to the faucet assembly 10. In one illustrative embodiment, the supply tubes 72 and 74 are formed of cross-linked polyethylene (PEX).

Illustratively, the fluid couplings 66 and 68 are supported for movement from a hidden position on the inner side (illustratively, below the bottom surface 103) of the mounting deck 12, and an exposed position on the outer side (illustratively, above the top surface 78) of the mounting deck 12. As such, the inlet water conduits 60 and 62 may be fluidly coupled to and uncoupled from the quick release fluid couplings 66 and 68 from either the inner side of the outer side of the mounting deck 12. Supports (not shown) may be positioned below the mounting deck 12 for holding the fluid couplings 66 and 68 in position to facilitate coupling with the inlet water conduits 60 and 62, respectively. In one illustrative embodiment, the supports may be retractable thereby guiding the fluid couplings 66 and 68 to a home position below the mounting deck 12 after being extended to a position above the mounting deck 12.

Figure 5:
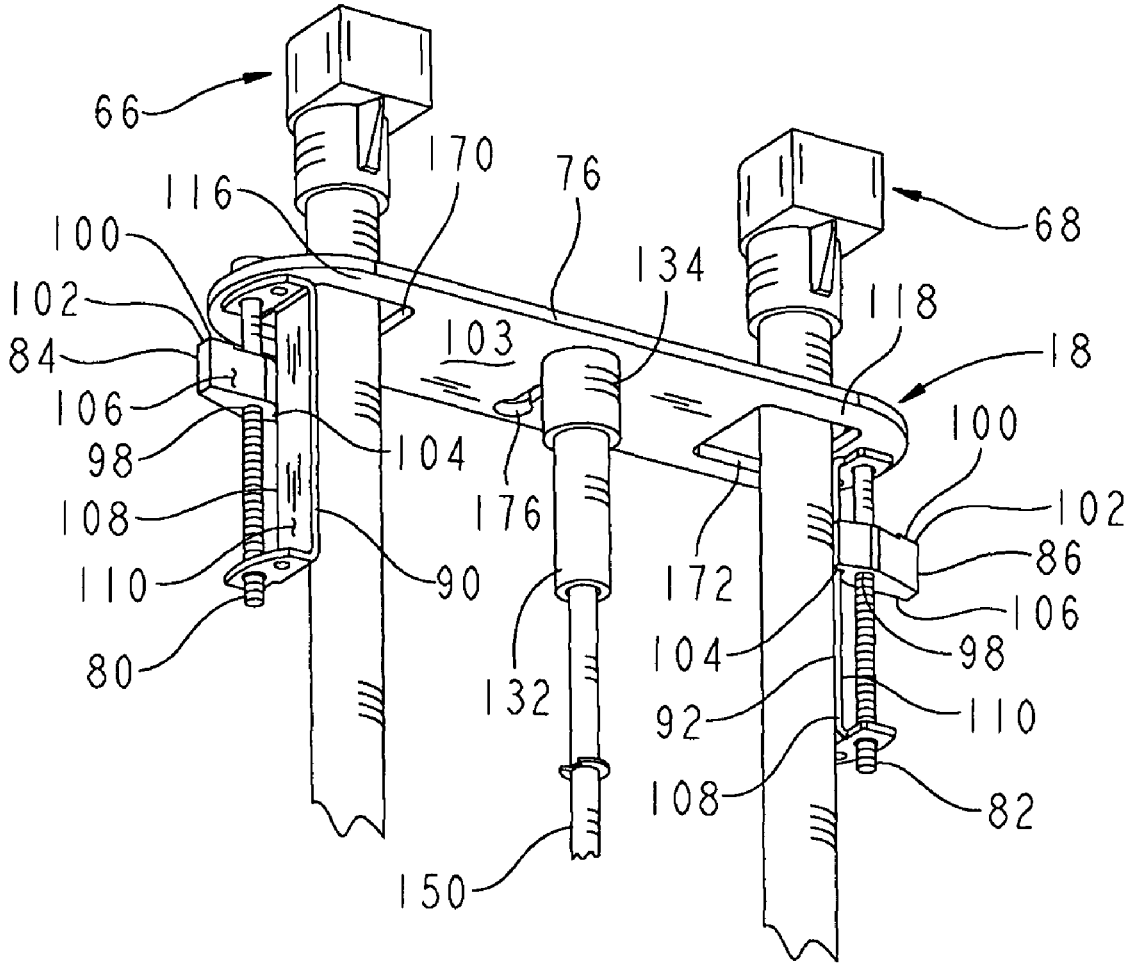
FIG. 5 is a bottom perspective view of the mounting base of FIG. 4.

As shown in FIGS. 2 and 5, the mounting base 18 includes a mounting plate 76 and is illustratively mounted from the top of the mounting deck 12 and sits on a top surface 78 thereof. It should be noted that the mounting base 18 may also be mounted from the underside of the mounting deck 12.

First and second attachment posts 80 and 82 extend downwardly from the mounting plate 76. The attachment posts 80 and 82 each include a plurality of external threads and are configured to operably couple with first and second mounting base locking members 84 and 86, respectively. An upper end of each post 80, 82 extends through the mounting plate 76 and includes a head 88 configured to be manipulated by a tool, such as a screwdriver (not shown). Brackets 90 and 92 extend substantially parallel to the attachment posts 80 and 82, respectively. Upper and lower apertures 94 and 96 of each bracket 90 and 92 receive the attachment posts 80 and 82, respectively.

The mounting plate locking members 84 and 86 each includes a threaded opening 98 configured to threadably engage the respective attachment post 80 and 82. Each locking member 84 and 86 further includes an upwardly extending clamping finger 100 configured to cooperate with the mounting plate 76 to clamp the mounting base to the deck 12. When the mounting plate 76 is on the mounting deck 12, the threaded attachment posts 80 and 82 are rotated to cause the mounting plate locking members 84 and 86 to move up or down on the posts 80 and 82, respectively. Counterclockwise rotation of attachment posts 80 and 82 causes locking members 84 and 86 to move downwardly or away from countertop 10 to an unlocked position. Clockwise rotation of attachment posts 80 and 82 causes locking members 84 and 86 to move upwardly or toward mounting deck 12 to a locked position. In the locked position, the top surface 102 of fingers 100 of locking members 84 and 86 abut the bottom or underside 103 of mounting deck 12, thereby securing mounting plate 76 thereto.

The locking members 84 and 86 are prevented from rotating with the attachment posts 80 and 82 as they are turned, by guide surfaces 104 and 106 of each locking member 84 and 86. Guide surfaces 104 and 106 abut against cooperating surfaces 108 and 110 of the brackets 90 and 92 upon rotation of the locking members 84 and 86, respectively. This causes locking members 84 and 86 to ride up or down attachment posts 80 and 82 as they are rotated instead of rotating 360 degrees with the rotation of the posts 80 and 82. As noted above, attachment posts 80 and 82 are stabilized and secured at their bottom portions by brackets 90 and 92.

Gasket 19 is illustratively received around the periphery of the mounting base 18 and is supported by the top surface 78 of the mounting deck 12. The gasket 19 is configured to fill the gap 90 between a lower edge of the body housing 22 and the top surface of the mounting deck 12. Illustratively, the gasket 19 is formed from a resilient material, such as an elastomer.

Figure 12:
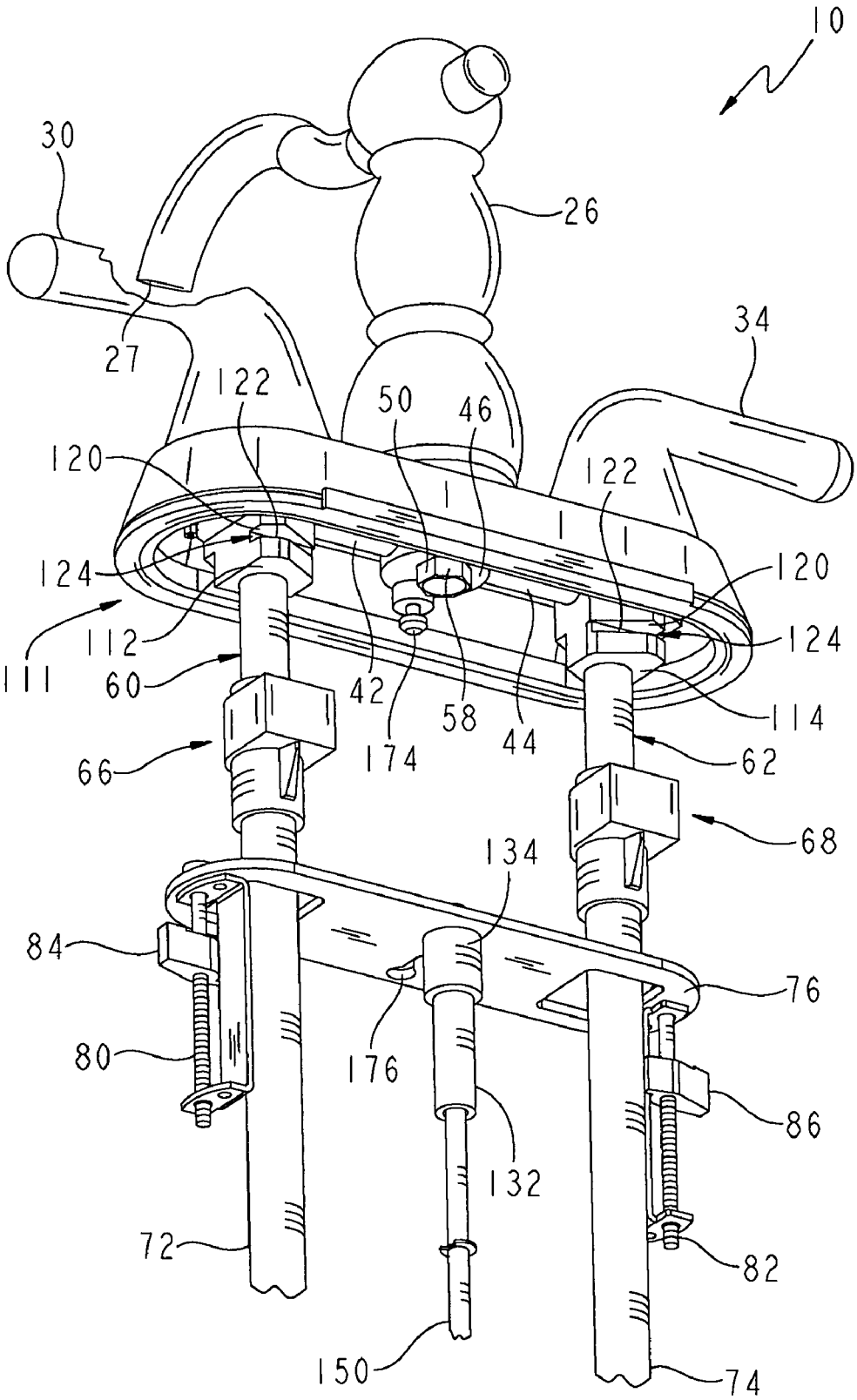
FIG. 12 is a bottom perspective view of the faucet assembly of FIG. 1, showing inlet water conduits fluidly coupled to the quick release fluid couplings above the mounting base.
Figure 13:
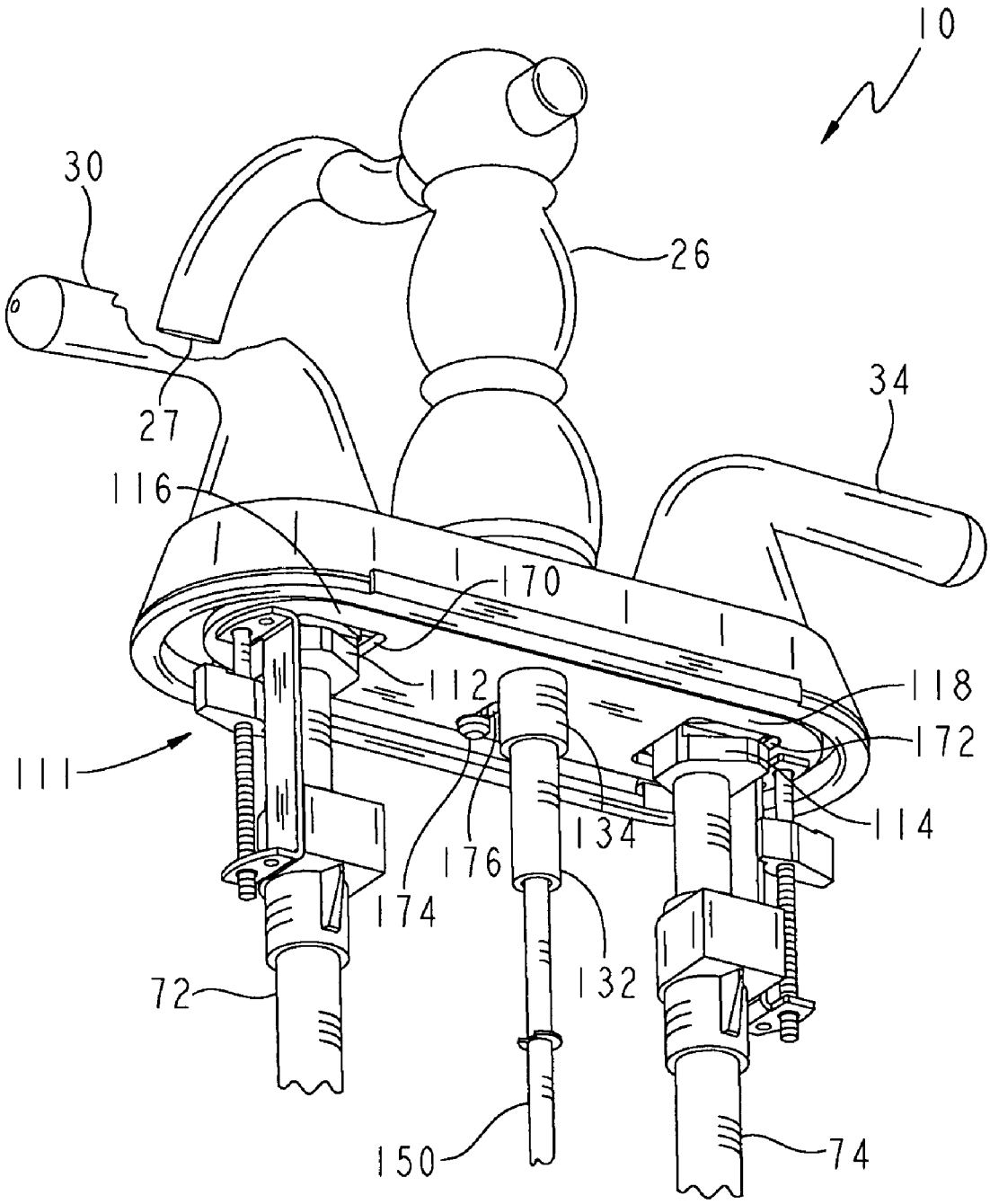
FIG. 13 is a view similar to FIG. 12, showing the quick release fluid couplings positioned below the mounting base.

With reference to FIGS. 2, 12, and 13, the coupler 28 includes a first locking device 111 which is configured to prevent vertical movement of the upper faucet assembly 17 relative to the mounting base 18. In other words, the first locking device 111 is configured to restrain the upper faucet assembly 17 from movement perpendicular to the mounting deck 12. Illustratively, the first locking device 111 is configured to couple upper faucet assembly brackets 112 and 114, supported by the housings 38 of the valves 32 and 36, to flanges 116 and 118, formed by the mounting base 18. The brackets 112 and 114 each illustratively include opposing upper and lower surfaces 120 and 122 defining a receiving slot 124 (FIG. 12). The lower surface 122 is inclined upwardly relative to the upper surface 120 such that the slot 124 is tapered. More particularly, the lower surface 122 angles upwardly as it extends in a direction from a rear portion 126 of the housing 38 toward a front surface 128 of the housing 38. While in the illustrated embodiment the brackets 112 and 114 are formed integral with the valve housings 38, it should be appreciated that the brackets 112 and 114 may be formed as separate components coupled to the upper faucet assembly 17.

The receiving slot 124 of each bracket 112 and 114 is configured to receive flange 116 and 118 formed by the mounting plate 76. As may be appreciated, as the upper faucet assembly 17 is moved rearwardly with the flanges 116 and 118 received within the respective receiving slots 124, the angled lower surface 122 forces the brackets 112 and 114 downwardly. In other words, sliding movement of the brackets 112 and 114 into the flanges 116 and 118 causes a camming action forcing the upper faucet assembly 17 down, while also locking the upper faucet assembly 17 in a vertical position.

A second locking device 130 prevents horizontal sliding motion of the upper faucet assembly 17 relative to the mounting base 18. In other words, the second locking device 130 is configured to restrain the upper faucet assembly 17 from movement parallel to the mounting deck 12. As such, the second locking device 130 also prevents vertical movement of the faucet assembly 17 relative to the mounting base 18 when the flanges 116 and 118 are received within the brackets 112 and 114, respectively. The second locking device 130 includes an externally threaded lock bushing 132 which cooperates with the bushing 50 coupled to the bottom of the waterway hub 46. The lock bushing 132 is threadably received within an internally threaded collar 134 which is fixed within an opening 135 formed in the mounting plate 76. The lock bushing 132 includes a central passageway 136 with an upper end 138 configured to couple with securing tool 140, illustratively an Allen or hex socket wrench. The upper end 138 further includes a chamfered surface 142 for cooperating with the bushing 50.

As may be appreciated, rotation of the lock bushing 132 within the collar 134, causes the lock bushing 132 to move up or down. As the lock bushing 132 is move upwardly, the surface 142 of the upper end 138 will engage the receiver 58 of the bushing 50, thereby preventing horizontal movement therebetween. As such, horizontal movement of the upper faucet assembly 17 relative to the mounting base 18 is prevented.

Figure 17:
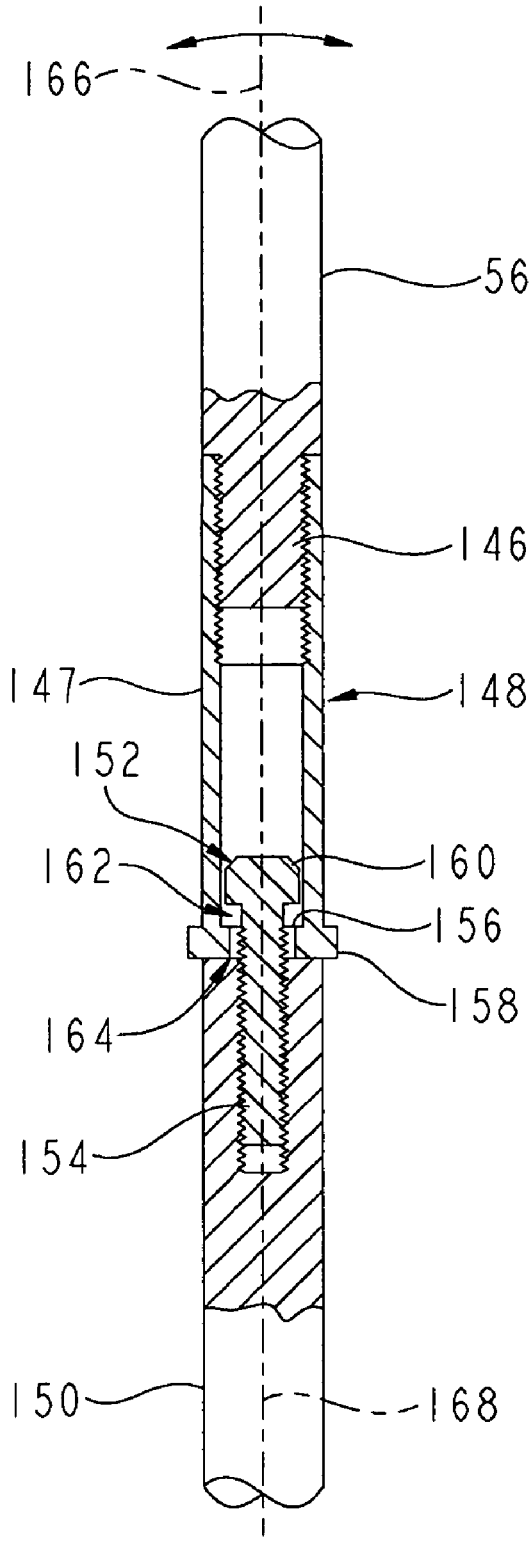
FIG. 17 is a detailed view with a partial cut-away, illustrating the coupling between the upper lift rod and the lower lift rod of the faucet assembly of FIG. 1.

With reference to FIGS. 1 and 17, the upper lift rod 56 includes an upper end, illustratively having a knob or finial 144, and a lower end, illustratively having an externally threaded portion 146. The externally threaded portion 146 is received within an internally threaded portion 147 of a pivot or wobble bushing 148. A lower lift rod 150 is coupled to the pivot bushing 148 through a fastener, such as screw 152. The outer diameter of the threaded shaft 154 of the screw 152 is smaller than a thru-hole 156 formed in a lower end wall 158 of the pivot bushing 148. However, the head 160 of the screw 152 has an outer diameter greater than the thru-hole 156 and, as such, may rest on the end wall 158. An axial gap 162 between the head 160 and the end wall 158, and a radial gap 164 between the shaft 154 and the end wall 158, together permit pivoting movement of the upper lift rod 56 relative to the lower lift rod 150. In other words, the axis 166 of the upper lift rod 56 may be angularly adjusted relative to the axis 168 of the lower lift rod 150, as a result of the angular play or wobble in the pivot bushing 148.

Figure 18:
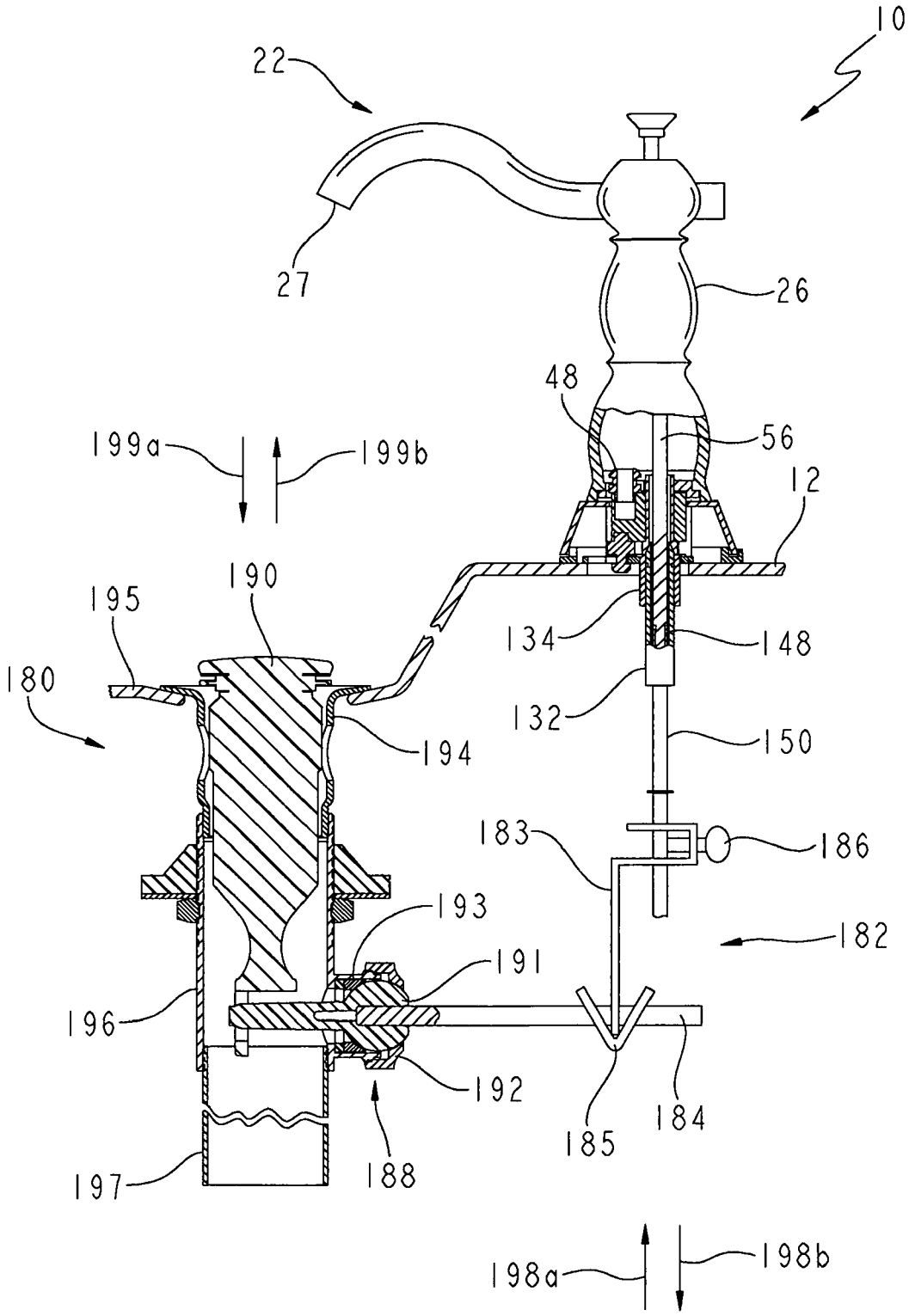
FIG. 18 is a cross-sectional view illustrating the faucet assembly of FIG. 1 coupled to a pop-up drain assembly.

With reference to FIGS. 17 and 18, the upper lift rod 56 is illustratively configured to cooperate with the lower lift rod 150 in order to operate a pop-up drain assembly 180. The lower end of the lower lift rod 150 is coupled to the drain assembly 180 through a conventional bracket assembly 182. The bracket assembly 182 includes a connector bar 183 with a plurality of holes spaced apart along a portion of its length and through which a first end of a pivot arm 184 is inserted and retained thereto by a bent clip or bracket 185. The upper end of the bar 183 is bent in a backward "C" shape and has openings through which the lower lift rod 150 is disposed and held at a desired position by a set screw 186.

The pivot arm 184 is configured to pivot about a pivot seat 188 in order to raise and lower a stopper or plug 190 coupled to a second end of the pivot arm 184. More particularly, the pivot seat 188 includes a truncated ball 191 supported for pivoting movement within a pivot nut 192 and cooperating pivot base 193. The plug 190 is received within a flange 194 supported by the sink basin 195. The flange 194 is in fluid communication with a tubular drain body 196 which is in fluid communication with a tail piece 197 for coupling to a conventional drain pipe (not shown).

In operation, pulling up on the handle 144 raises the upper lift rod 56. In response, the coupling 148 causes the lower lift rod 150 and, in turn, the bracket assembly 182 and the first end of the pivot arm 184 to move upwardly in the direction of arrow 198*a*. The pivot arm 184 pivots about the pivot seat 188, thereby causing downward movement of the plug 190 in the direction of arrow 199*a*. Pushing down on the raised handle 144 lowers the upper lift rod 56. In response, the coupling 148 causes the lower lift rod 150 and, in turn, the bracket assembly 182 and the first end of the pivot arm 184 to move downwardly in the direction of 198*b*. The pivot arm 184 pivots about the pivot seat 188, thereby causing upward movement of the plug 190 in the direction of arrow 199*b*.

To mount the mounting base 18 onto the mounting deck 12, mounting plate locking members 84, 86, attachment posts 80, 82, support brackets 90, 92, lock bushing 132, collar 134, pivot bushing 148, and lower lift rod 150 are inserted from an exposed position on the outer side (illustratively, above the top surface 78) of the mounting deck 12 through the access openings 14, 15, 16. To remove the mounting base 18 from the mounting deck 12, the attachment posts 80 and 82 are turned in a counter-clockwise manner moving the locking members 84 and 86 downwardly away from the underside of the mounting deck 12. The mounting plate locking members 84, 86, attachment posts 80, 82, support brackets 90, 92, lock bushing 132, collar 134, pivot bushing 148, and lower lift rod 150 are then pulled from a hidden position on the inner side (illustratively, below the bottom surface 103) of the mounting deck 12, up through the access openings 14, 16 in the mounting deck 12.

Figure 7:
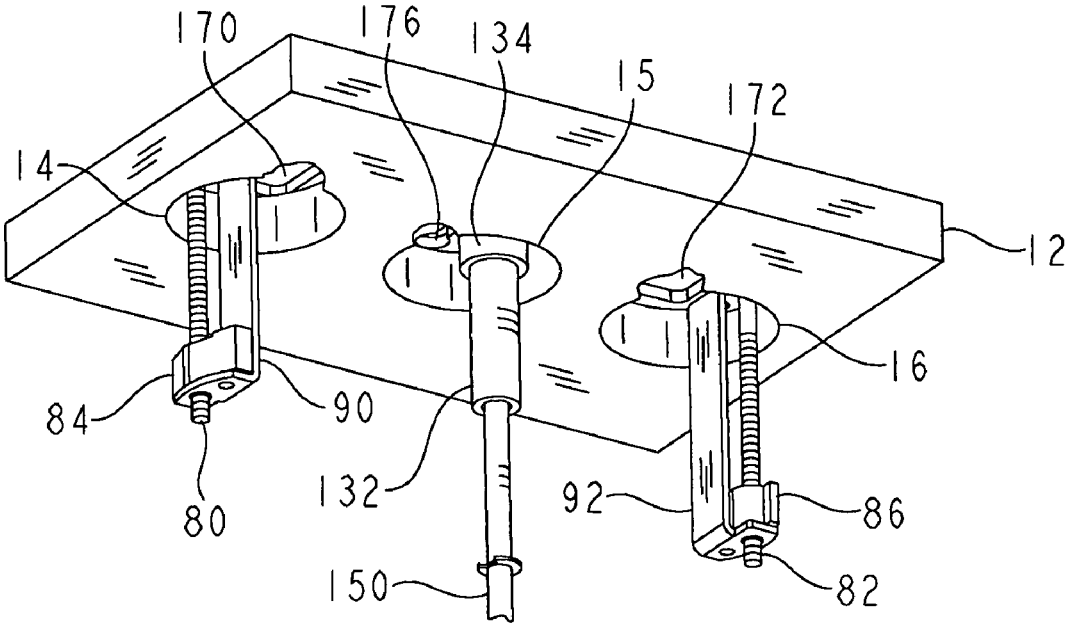
FIG. 7 is a perspective view similar to FIG. 6, illustrating the mounting base positioned within the mounting deck.
Figure 8:
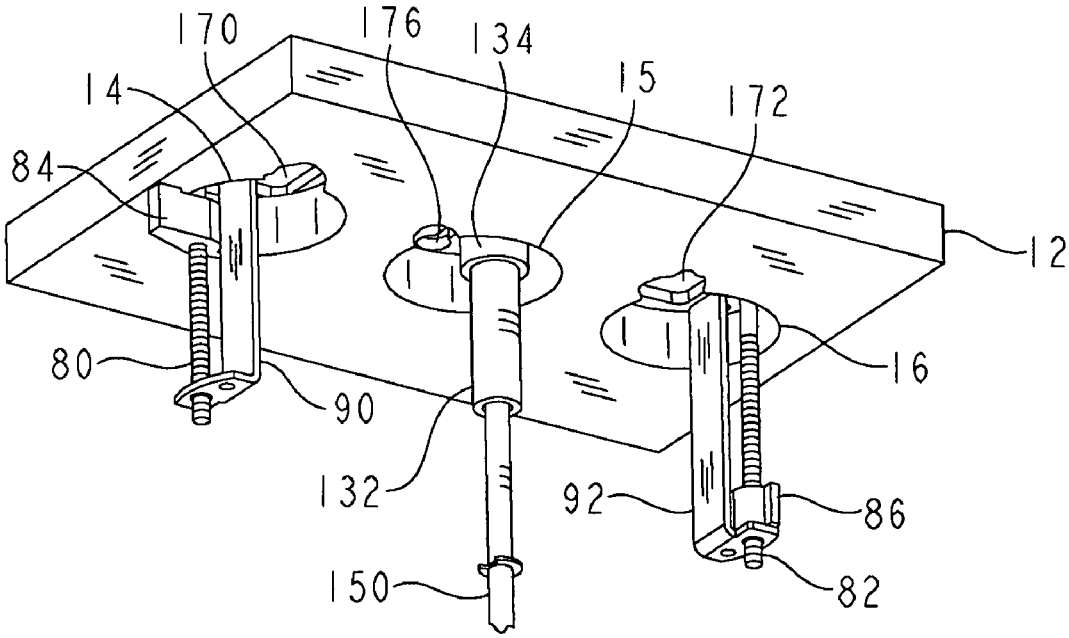
FIG. 8 is a perspective view similar to FIG. 7, illustrating a first locking member clamping the mounting base to the mounting deck.

As shown in FIG. 7, in the unlocked or down position fingers 100 of locking members 84 and 86 are swiveled against the brackets 90 and 92, respectively. More particularly, guide surfaces 106 of locking members 84 and 86 engage surfaces 110 of brackets 90 and 92. As such, the locking members 84 and 86 can be pulled out through access openings 14 and 16.

Figure 9:
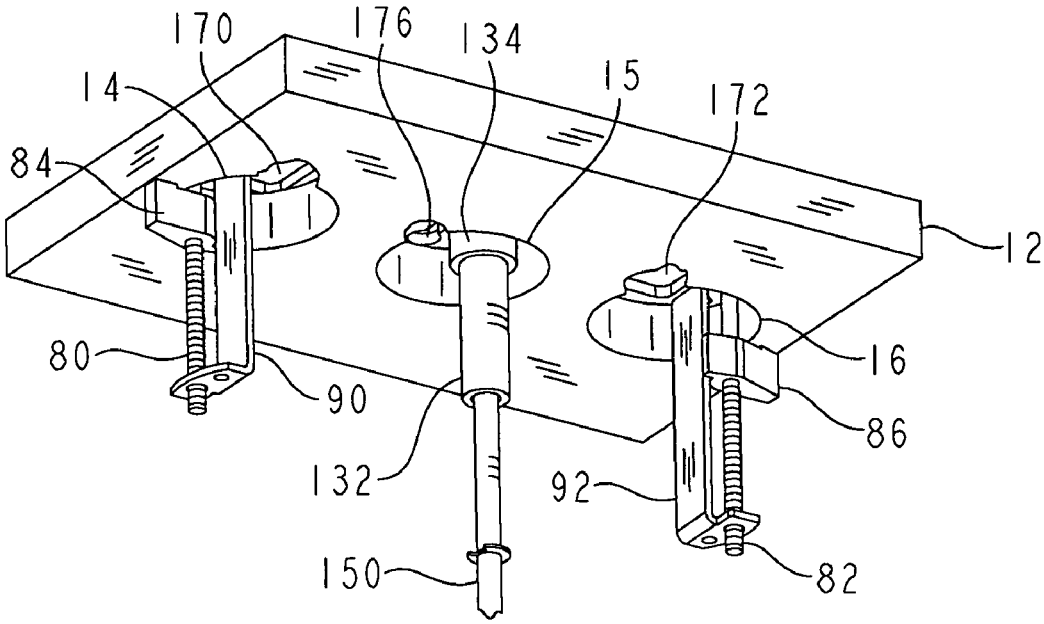
FIG. 9 is a perspective view similar to FIG. 8, illustrating both locking members clamping the mounting base to the mounting deck.

As seen in FIG. 9, in the up or locked position fingers 100 of locking members 84 and 86 are swiveled away from brackets 90 and 92 and their top surfaces 102 abut against the bottom or underside of mounting deck 12. More particularly, guide surfaces 104 of locking members 84 and 86 engage surfaces 108 of brackets 90 and 92. In this position, the fingers 100 cannot be pulled through access openings 14 and 16.

Figure 6:
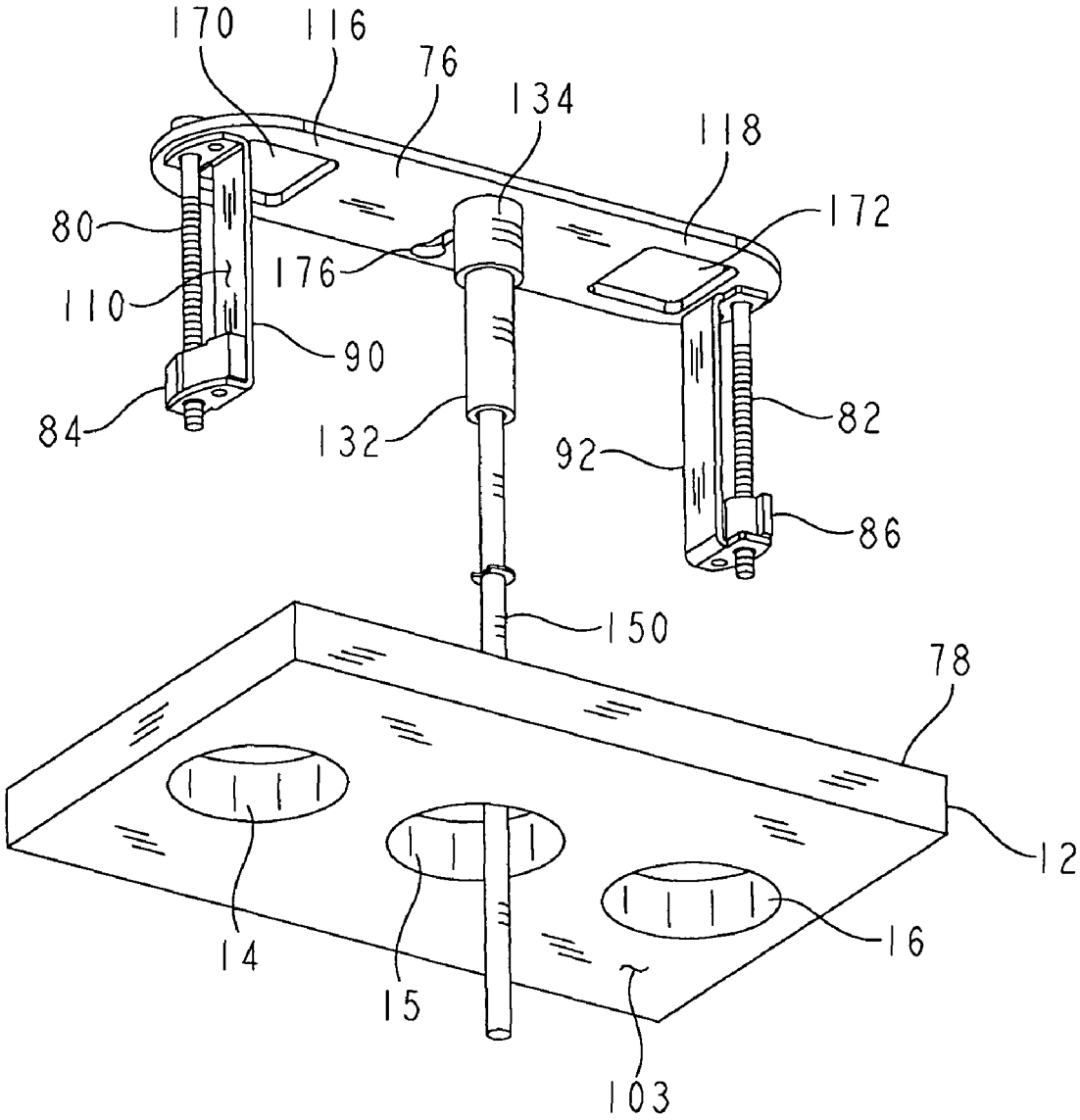
FIG. 6 is a bottom perspective view of the mounting base of FIG. 4, showing initial positioning relative to a mounting deck.
Figure 10:
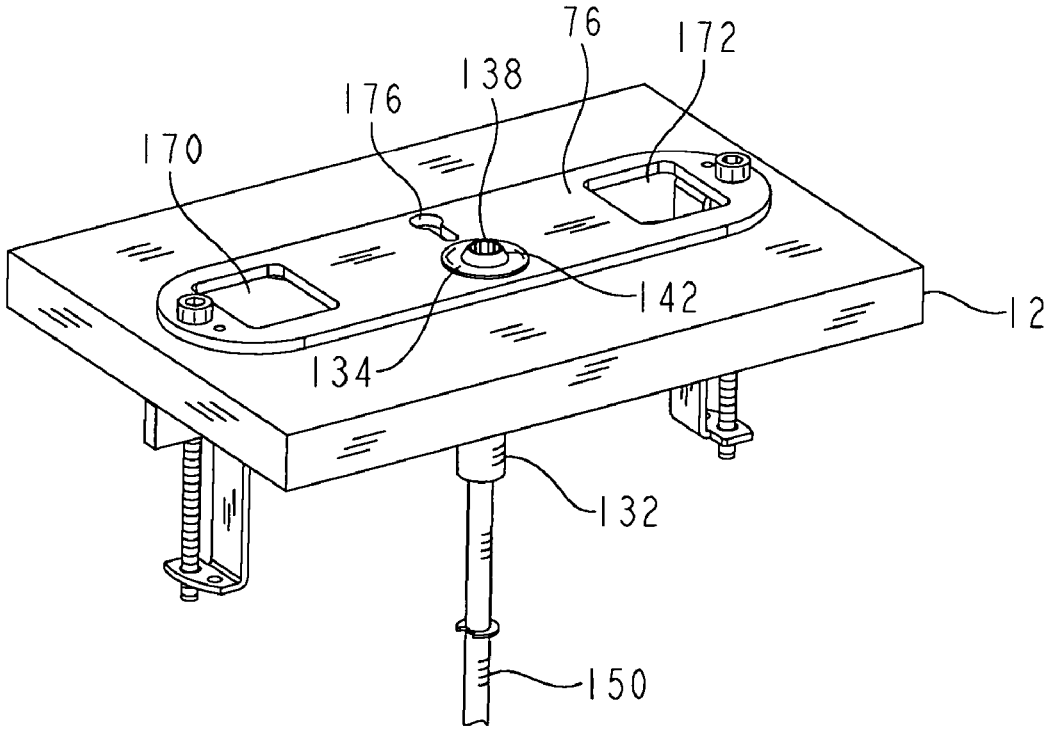
FIG. 10 is a top perspective view of the mounting base of FIG. 4 illustrating the mounting base as coupled to the mounting deck, with the lock bushing in a raised position.

To begin installation of the illustrative embodiment faucet assembly 10 of the present invention, the mounting base 18 is coupled to the mounting deck 12 by passing the attachment posts 80, 82, support brackets 90, 92, locking members 84, 86, collar 134, lock bushing 132, pivot bushing 138, and lower lift rod 150 from the exposed position on the outer side of the mounting deck 12, through access openings 14, 15, and 16 as shown in FIGS. 6 and 7. The mounting plate 76 is then lowered until it rests on the mounting deck 12. Next, the attachment post 80 is rotated such that the locking member 84 moves upwardly along the length of the post 80 and the top surface 102 of the clamping finger 100 engages the lower surface of the mounting deck 12 thereby clamping the deck 12 between the locking member 84 and the mounting plate 76. As shown in FIG. 9, the same method is used with the attachment post 80 and the locking member 86 to cause clamping of the mounting deck between the locking member 86 and the mounting plate 76. The clamped position of the mounting base is illustrated in FIGS. 9 and 10.

Figure 11:
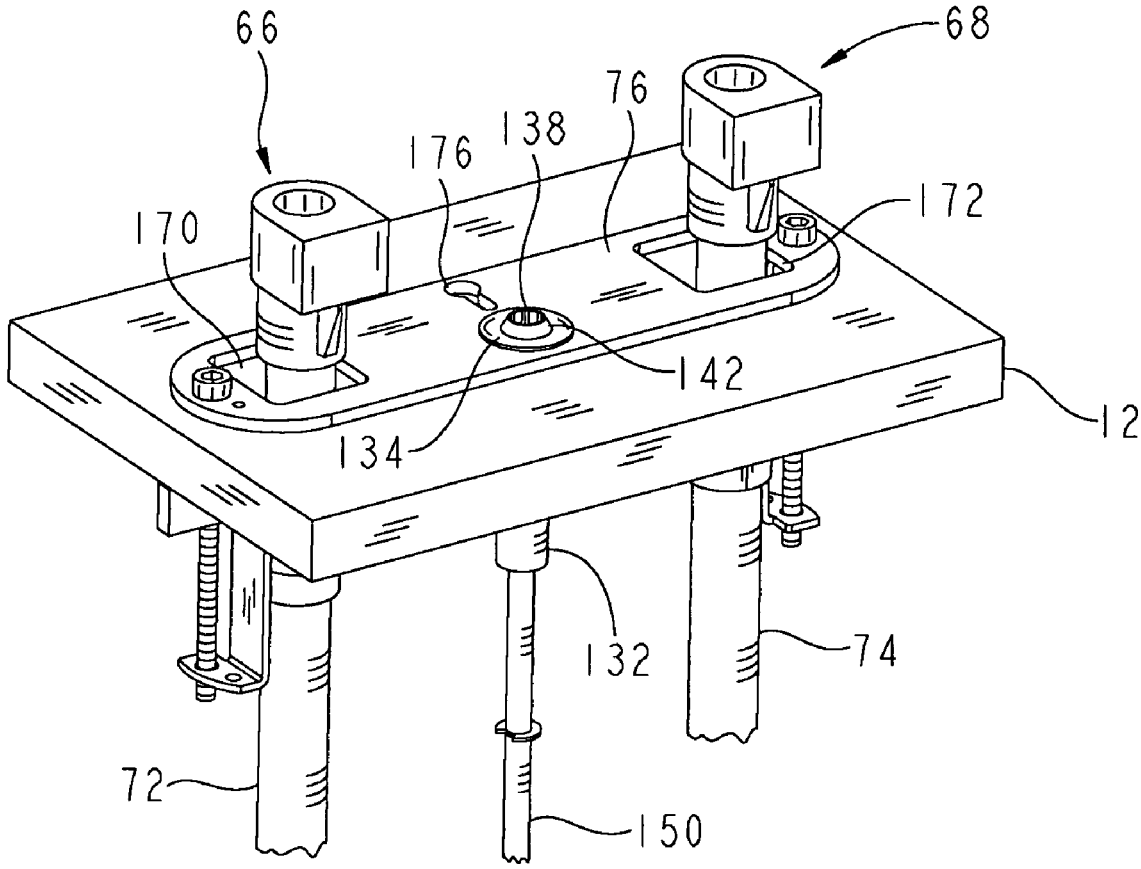
FIG. 11 is a perspective view similar to FIG. 10, showing quick release fluid couplings extending upwardly through the mounting base.

The installation process continues as shown in FIG. 11 by passing the quick release fluid couplings 66 and 68 and associated tubes 72 and 74 from the hidden position on the inner side of the mounting deck 12 through access openings 14, 16 and openings 170, 172 formed in the mounting plate 76. As shown in FIG. 12, the connection ends 64 of the inlet conduit 60 and 62 are then inserted within the quick release couplings 66 and 68 to provide fluid communication between the tubes 72, 74 and conduit 60, 62. It should be appreciated that inlet conduits 60 and 62 may also be fluidly coupled with the quick release couplings 66 and 68, respectively, from the inner side of the mounting deck 12.

Turning now to FIG. 13, the upper faucet assembly 17 is lowered into engagement with the mounting base 18. More particularly, the housings 38 of the valves 32 and 36 are lowered into the deck openings 14, 16 and mounting plate openings 170, 172 such that the brackets 112 and 114 are aligned with the flanges 116 and 118. More particularly, the slots 124 are aligned with the respective flanges and the entire upper faucet assembly 17 slid rearwardly as shown in FIG. 4. Cooperation between the flanges 116 and 118 and the angled lower surfaces 122 of the brackets 112 and 114 causes a camming action and downward movement of the upper faucet assembly 17. It should be noted that a guide pin 174 may extend downwardly from the hub 46 for receipt within a slot 176 formed in the mounting plate 76 in order to facilitate proper alignment.

Figure 14:
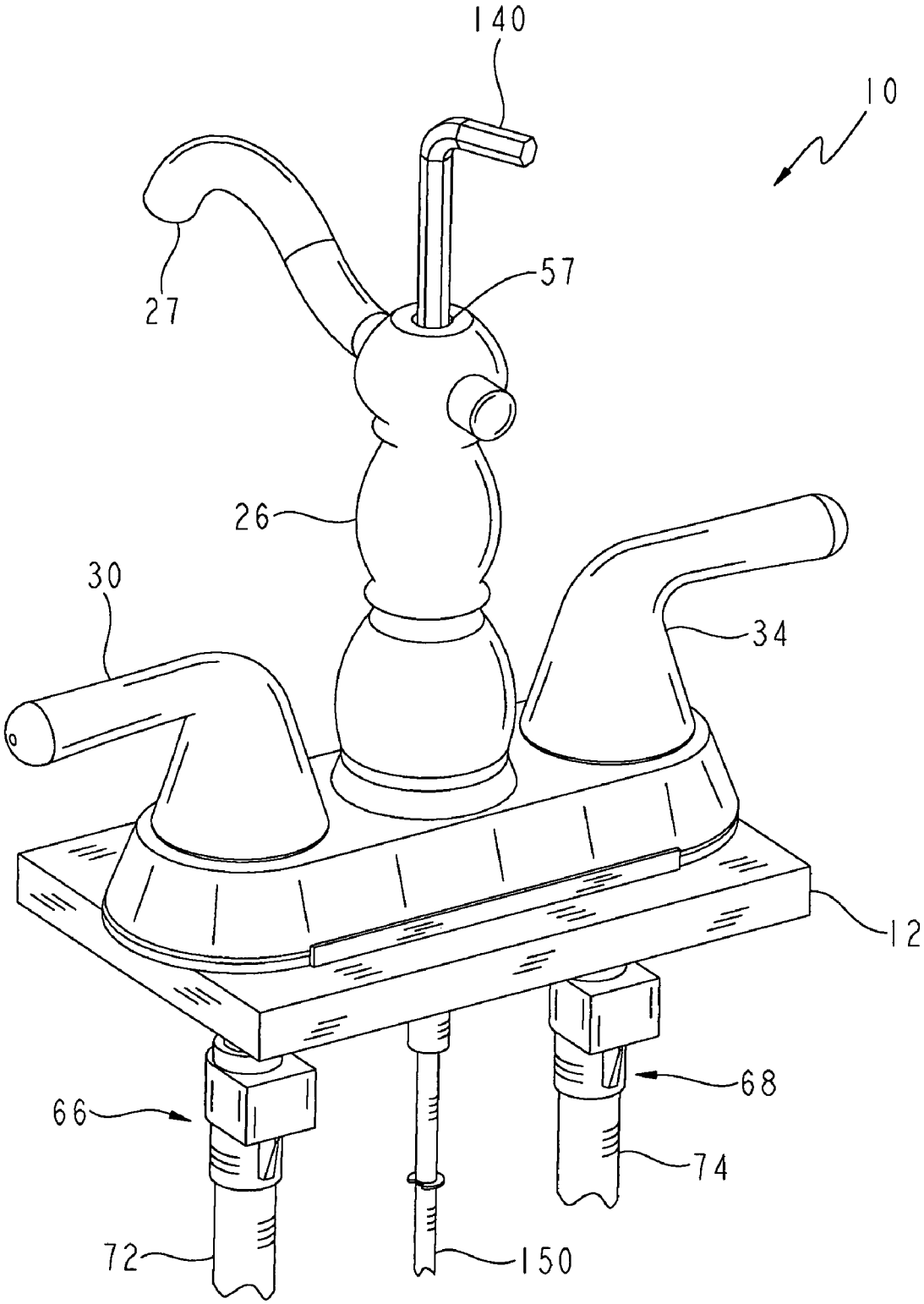
FIG. 14 is a rear perspective view of the faucet assembly of FIG. 1, with the upper lift rod removed thereby providing access to a lift rod passageway for a securing tool.

As shown in FIG. 14, the upper lift rod 56 is removed by unthreading it from the connection with the lower lift rod 150. Next, a socket head or Allen wrench 140 is passed downwardly through the upper lift rod passageway 57 formed within the spout 26 and housing 22.

Figure 15:
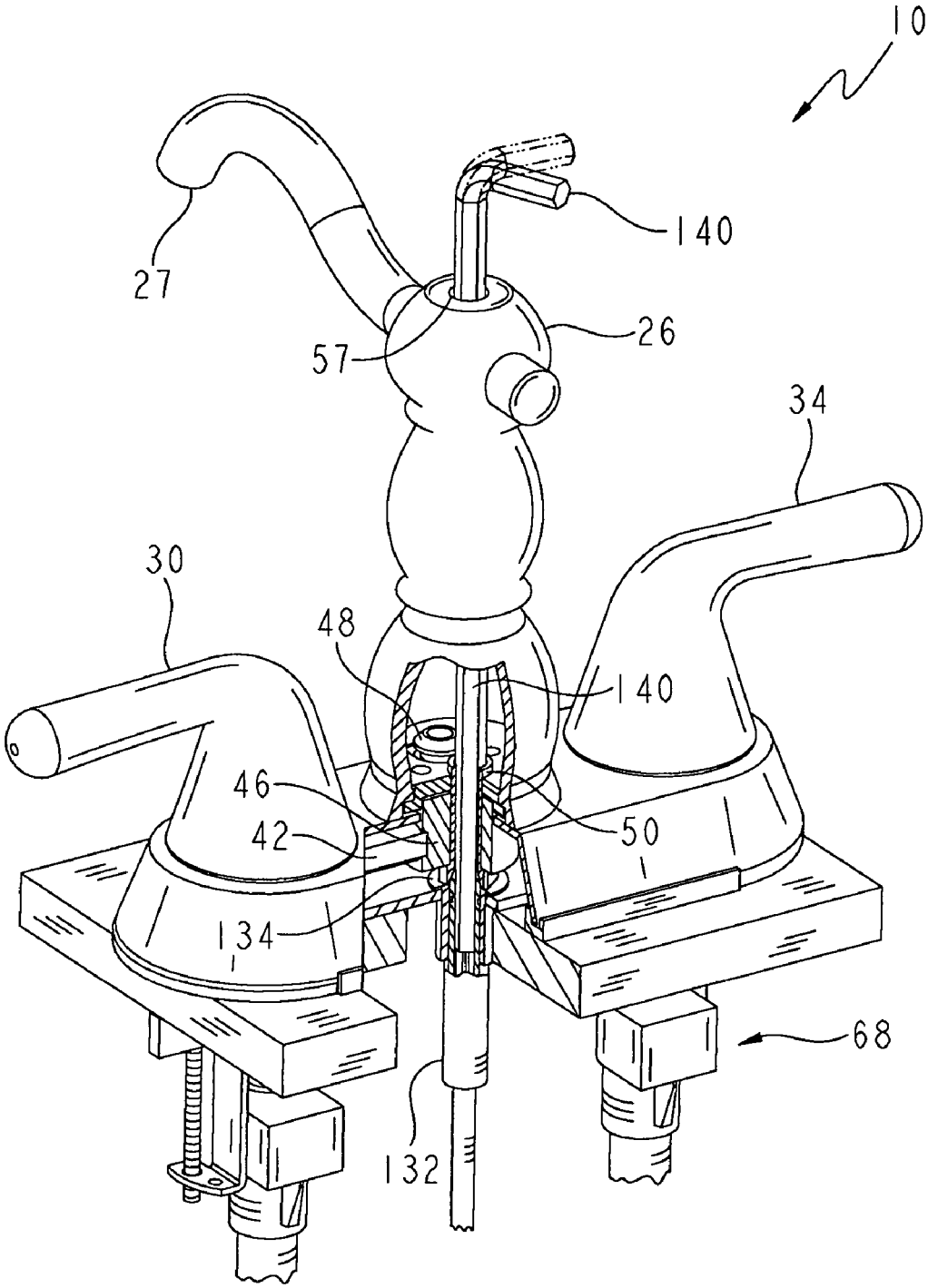
FIG. 15 is a perspective view similar to FIG. 14, with a partial cut-away thereof, illustrating cooperation between the securing tool and the locking member.
Figure 16A:
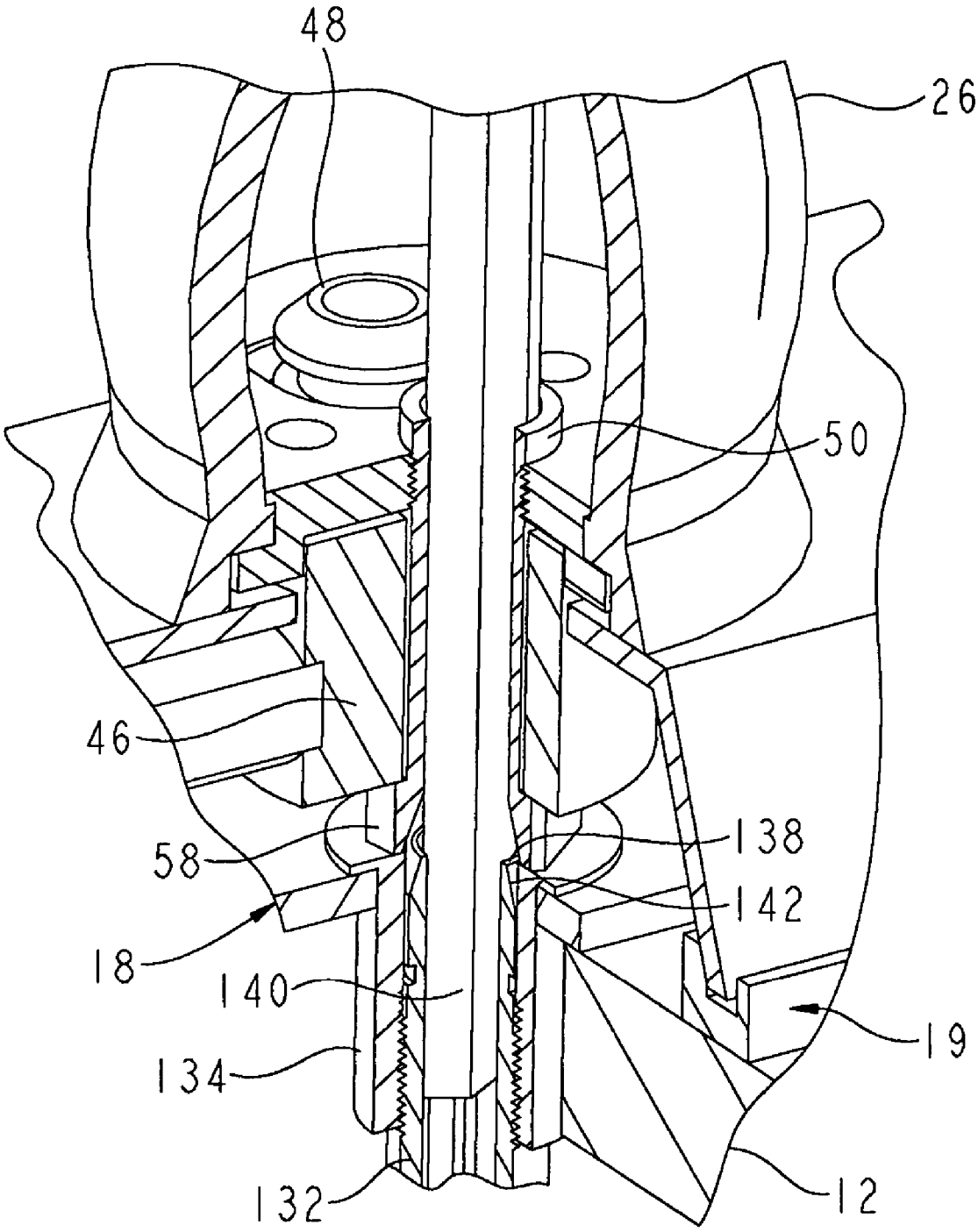
FIG. 16A is a detailed view of FIG. 15, illustrating the lock bushing in a lowered or unlocked position.
Figure 16B:
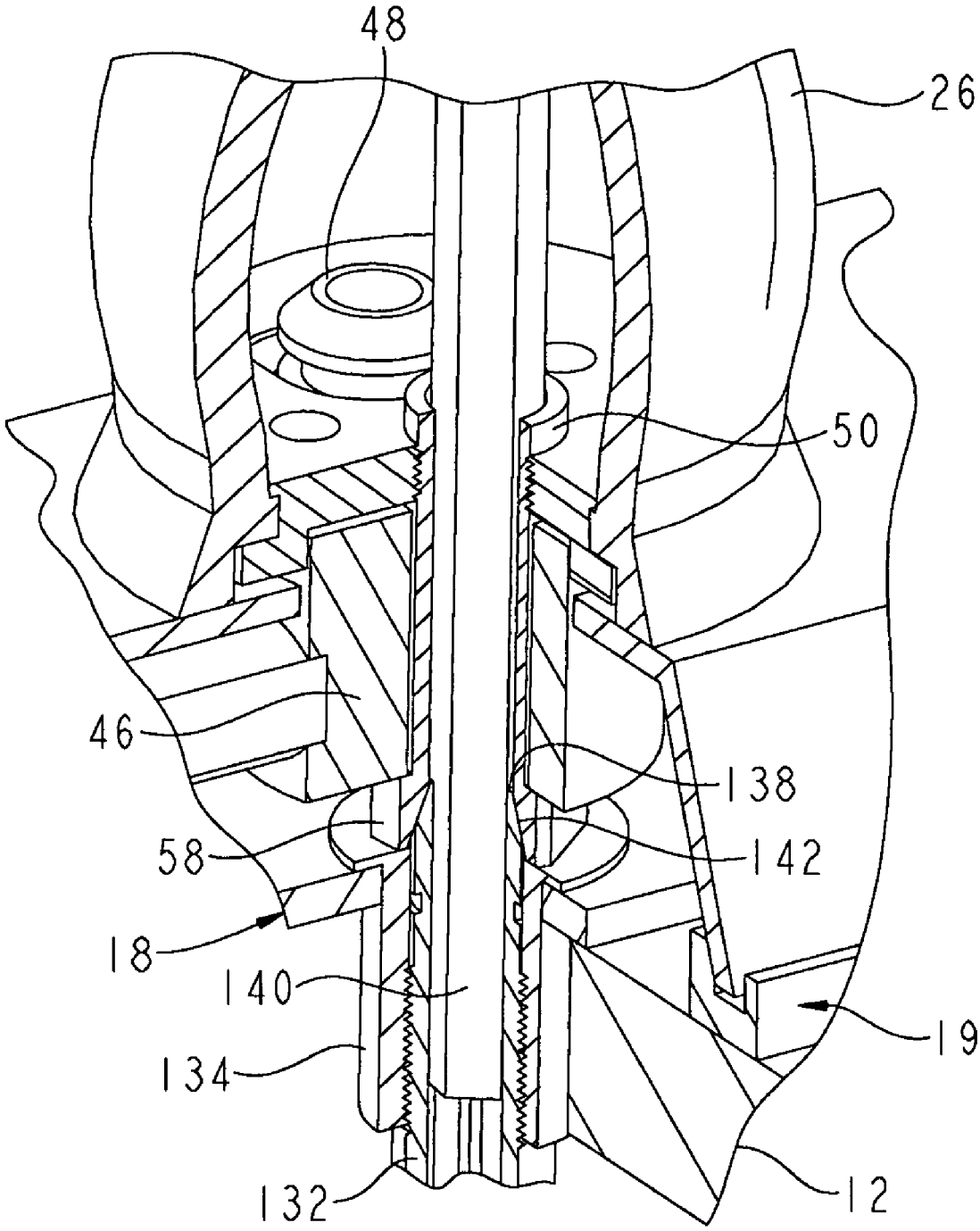
FIG. 16B is a detailed view similar to FIG. 16A, illustrating the lock bushing moved upwardly into a raised or locked position.

With reference now to FIG. 15, the wrench 140 passes through the bushing 50 and engages upper end 138 of the lock bushing 132. The wrench 140 is then rotated in a counterclockwise direction to cause the lock bushing 132 to move upwardly relative to the collar 134 and mounting plate 76 from a lowered or unlock position (FIG. 16A), to a raised or locked position (FIG. 16B) More particularly, in the locked position, the surface 142 of the lock bushing 132 is received within the receiver 58 of the bushing 50 thereby preventing sliding horizontal movement of the upper faucet assembly 17 relative to the mounting base 18. In other words, engagement between the brackets 112, 114 and flanges 116, 118 prevent vertical movement of the upper faucet assembly 17 relative to the mounting base 18, while engagement between the lock bushing 132 and the hub bushing 50 prevents horizontal movement between the upper faucet assembly 17 and the mounting base 18.

The upper lift rod 56 is then reinserted through the lift rod passageway and threaded into the coupling 148 with the lower lift rod 150. As such, it may be appreciated that the lift rod 56 may be uncoupled from and coupled to the drain assembly 180 entirely from above the mounting deck 12.

Figure 19:
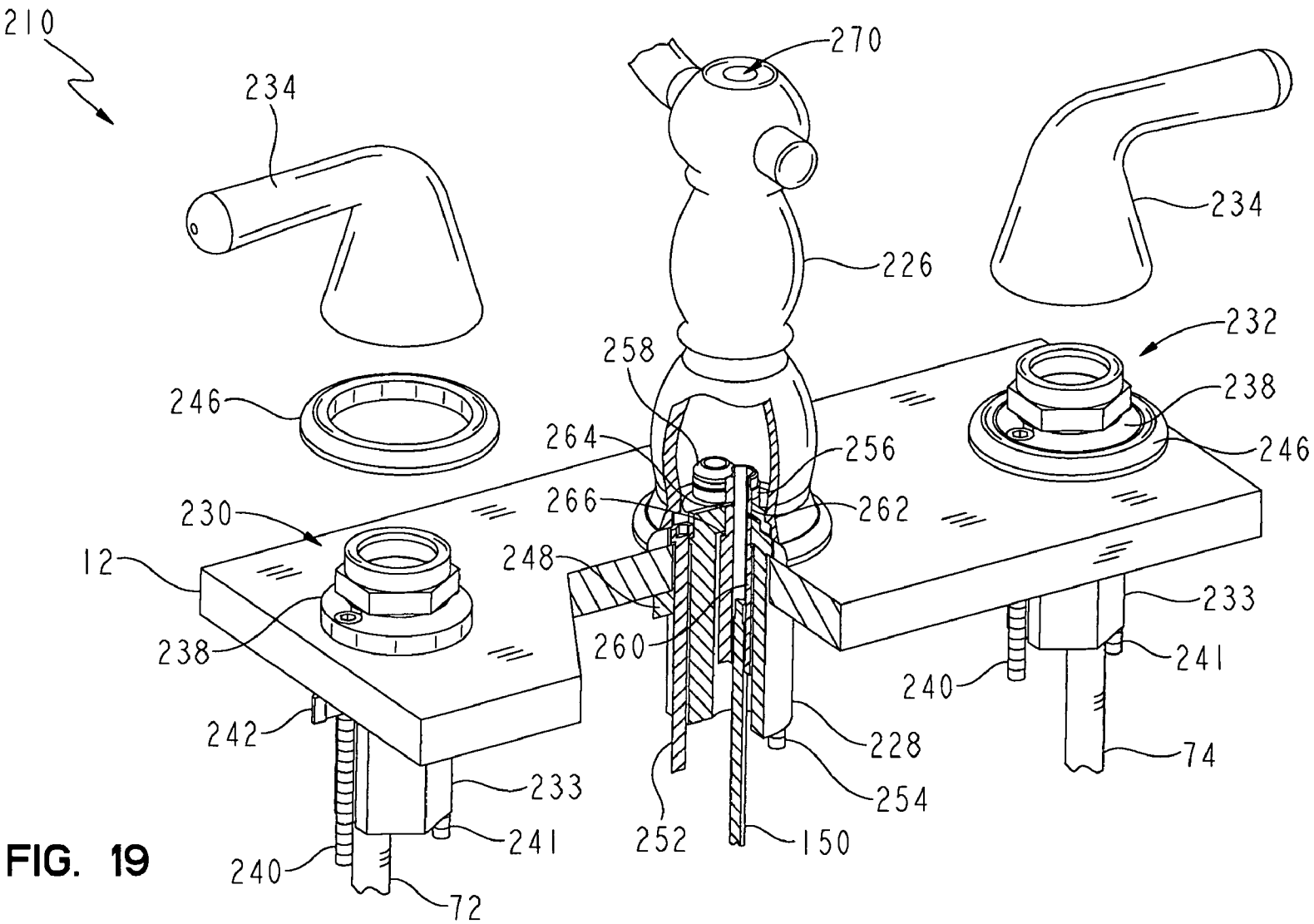
FIG. 19 is a perspective view of a further illustrative embodiment faucet assembly with a partial cut-away thereof and showing both the cold and hot water control handles and associated trim pieces removed.
Figure 20:
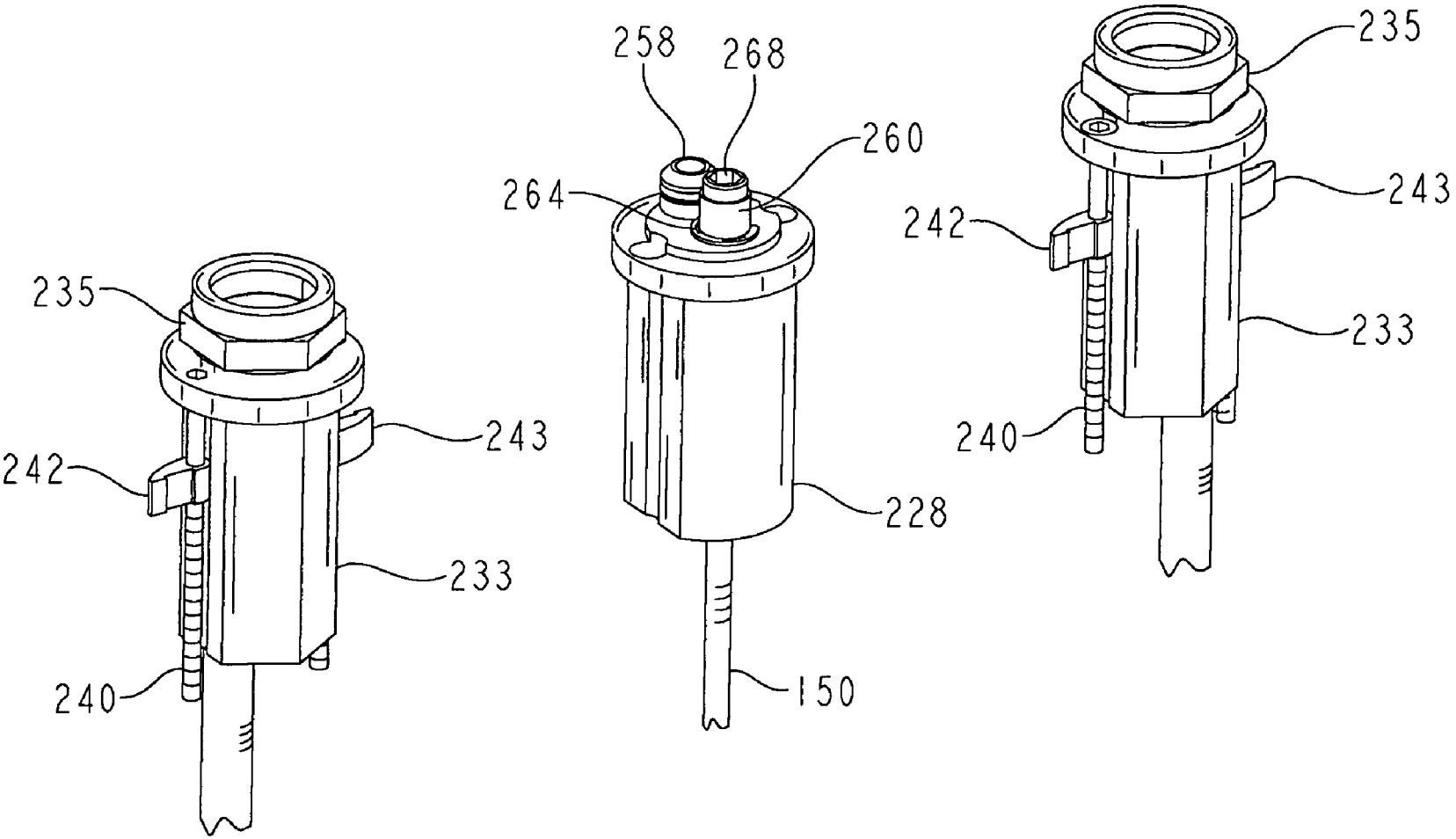
FIG. 20 is a perspective view of the handle mounting bases and the delivery spout mounting base of the faucet assembly of FIG. 19.
Figure 21:
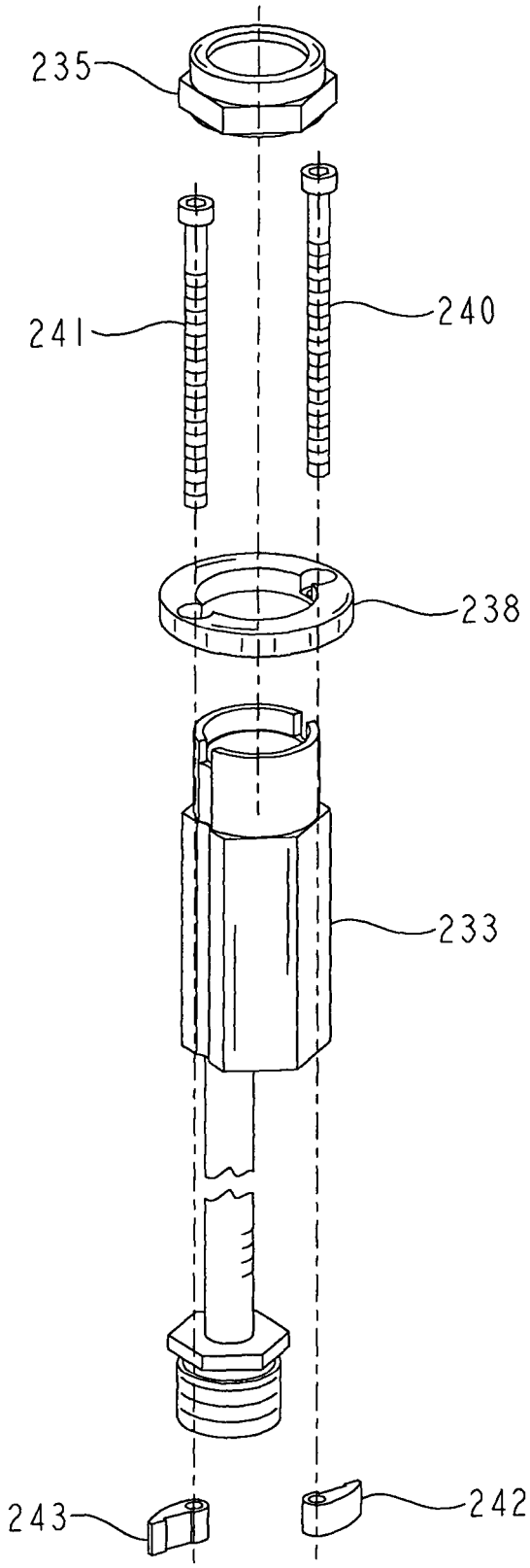
FIG. 21 is an exploded perspective view of the handle mounting base of FIG. 20.
Figure 22:
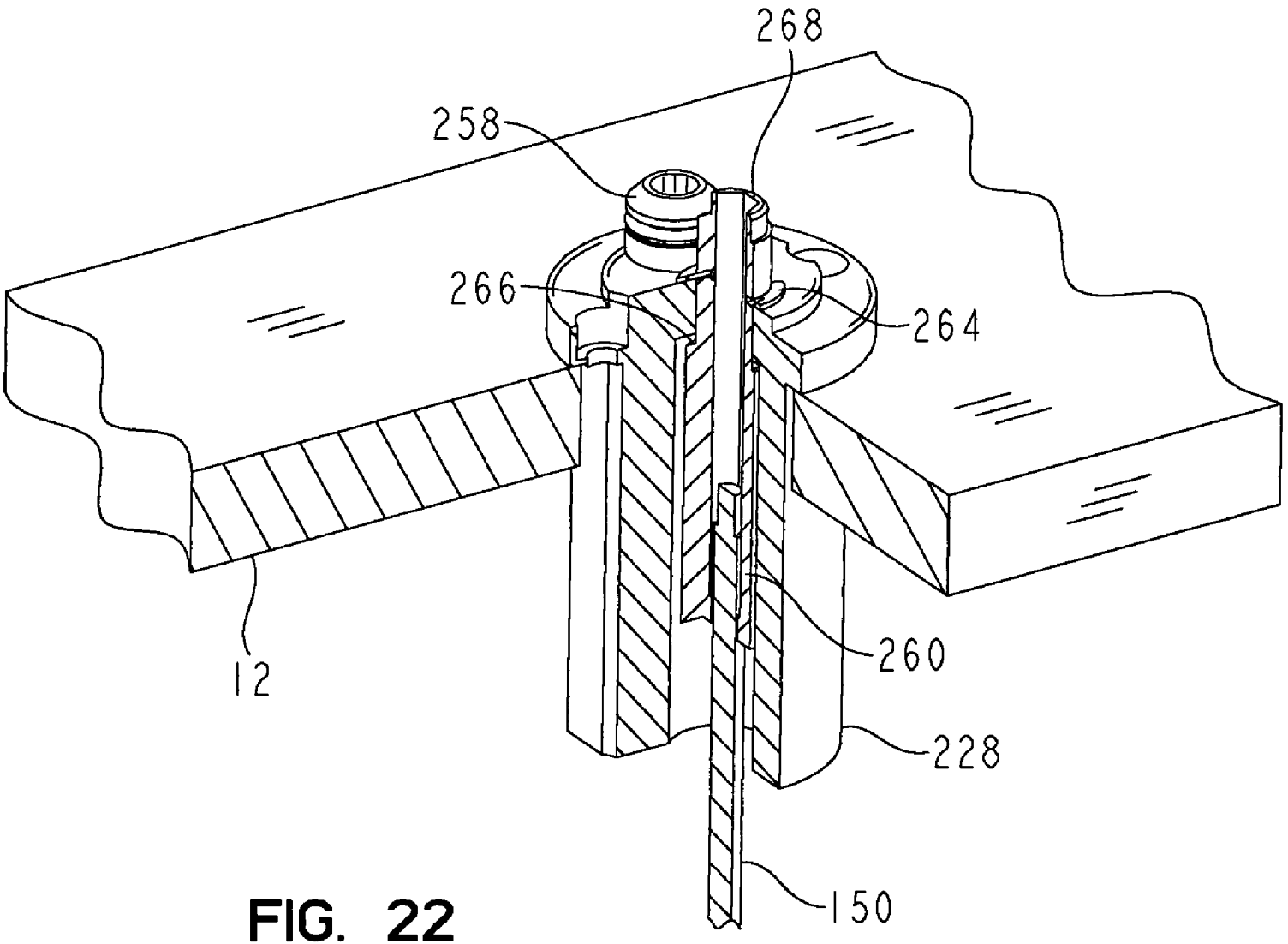
FIG. 22 is a perspective view, with a partial cut-away, of the delivery spout mounting base of the faucet assembly of FIG. 19.
Figure 23:
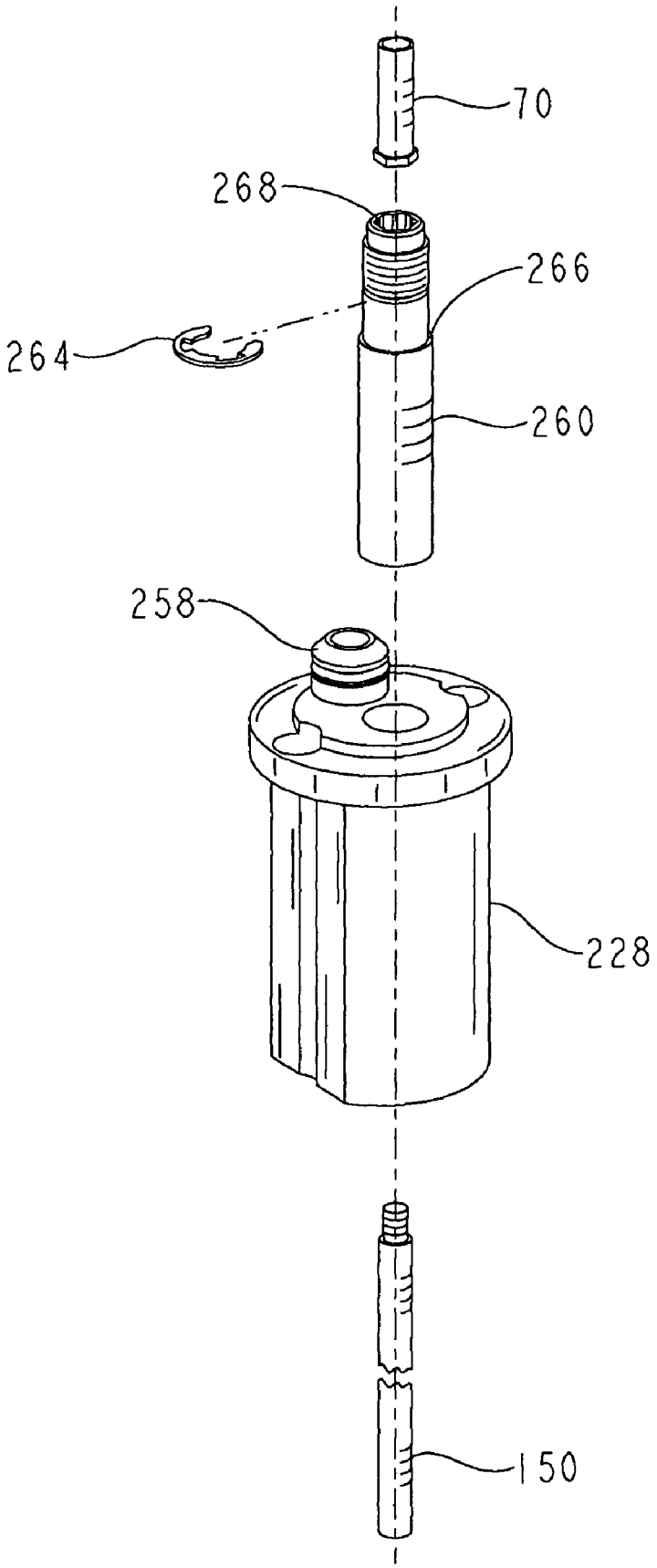
FIG. 23 is an exploded perspective view of the delivery spout mounting base of FIG. 22.

A further illustrative embodiment of a faucet assembly 210 of the present invention, often called a wide space spread faucet assembly, is illustrated in FIGS. 19-23. As shown in FIGS. 19 and 20, the faucet assembly 210 includes a spout 226 coupled to a delivery spout manifold or base 228. Cold and hot water valves 230 and 232 each include a valve base 233 likewise coupled to the mounting deck 12. The valve bases 233 are operably coupled to handles 234 in a manner known in the art, and illustratively threadably receive conventional bonnet nuts 235. A collar 238 is supported on each valve base 233. A pair of attachment posts 240 and 241 extend downwardly from each collar 238 and include locking members 242 and 243 threadably received thereon. The locking members 242 and 243 are configured to clamp a valve body to the deck 12 in a manner similar to that detailed above. A trim piece 246 may be threadably received on the outside of the collar 238 and the handle 234 then received thereover.

The delivery spout base 228 is secured to the sink deck 12 in a manner similar to the valve bodies 233. More particularly, the manifold base 228 is inserted through the opening 15 of the sink deck 12. First and second locking members 248 and 250 cooperate with first and second attachment posts 252 and 254 to clamp the base 228 in position. Next, the delivery spout 226 is positioned over the base 228. More particularly, a coupling plate 256 fixed to the delivery spout 226 is operably coupled to a base 228. A fluid nipple 258 extends upwardly through an opening in the coupling plate 256 and is configured to provide fluid communication with the outlet of the delivery spout 226.

A lock bushing 260 extends upwardly through the base 228 and is threadably received within a threaded opening 262 formed in the coupling plate 256. A retaining ring 264 is coupled to the lock bushing 260. A shoulder 266 formed on the lock bushing 260 cooperates with the retaining ring 264 to maintain the vertical position of the lock bushing 260 relative to the base 228. An upper end 268 of the lock bushing 260 is configured to cooperate with a wrench. More particularly, rotation of the upper end 268 of the lock bushing 260 causes the coupling plate 256 to move vertically relative thereto. More particularly, engagement between the threads of the opening 262 in the coupling plate 256 and the lock bushing 260 causes axial movement of the delivery spout 226 in response to rotational movement of the lock bushing 260. As with the earlier described embodiment, the wrench 140 accesses the lock bushing 260 through the lift rod passageway 270 formed in the delivery spout 226.

Although the invention has been described in detail with reference to certain preferred embodiments, variations and modifications exist within the spirit and scope of the invention as described and defined in the following claims.

The invention claimed is:

1. A faucet assembly comprising:

a mounting plate adapted to be removably coupled to a mounting deck, the mounting plate including a first flange;

an upper faucet assembly including a first valve housing supporting a bracket, the bracket having a cam slot configured to slidably receive the first flange of the mounting plate when the first valve housing is moved in a horizontal direction parallel to the mounting deck, the cam slot defined by opposing upper and lower surfaces, the lower surface inclined relative to the upper surface such that sliding movement of the bracket into the first flange causes a camming action forcing the upper faucet assembly down and locking the upper faucet assembly in a vertical position; and a locking mechanism including a lock bushing supported for movement relative to the mounting plate between lowered and raised positions, the lock bushing in the raised position configured to secure the upper faucet assembly by preventing sliding movement of the cam slot relative to the first flange.

2. The faucet assembly of claim 1, wherein the upper faucet assembly includes an inlet conduit having a connection end.

3. The faucet assembly of claim 2, further comprising a quick release fluid coupling configured to releasably couple with the connection end of the inlet conduit.

4. The faucet assembly of claim 3, wherein the quick release fluid coupling is supported for movement from a hidden position below the mounting plate and an exposed position above the mounting plate.

5. The faucet assembly of claim 1, wherein the upper faucet assembly further includes a housing having a lift rod passageway; and a lift rod configured to be received within the lift rod passageway, the lock bushing being accessible through the lift rod passageway.

6. The faucet assembly of claim 5, further comprising a drain assembly including a plug moveable in response to movement of the lift rod, the lift rod configured to be coupled and uncoupled from the drain assembly entirely from above the mounting deck.

7. The faucet assembly of claim 1, wherein the upper faucet assembly further includes a delivery spout and at least one valve configured to control the flow of water to the delivery spout.

8. The faucet assembly of claim 1, wherein:

the mounting plate further includes a second flange; and the upper faucet assembly further includes a second valve housing in spaced relation to the first valve housing, the second valve housing supporting a bracket having a cam slot configured to slidably receive the second flange of the mounting plate when the second valve housing is moved in a horizontal direction parallel to the mounting deck, the cam slot defined by opposing upper and lower surfaces, the lower surface inclined relative to the upper surface such that sliding movement of the bracket into the second flange causes a camming action forcing the upper faucet assembly down and locking the upper faucet assembly in a vertical position.

9. The faucet assembly of claim 8, wherein the first valve housing is fluidly coupled to a hot water inlet conduit and the second valve housing is fluidly coupled to a cold water inlet conduit.

10. The faucet assembly of claim 1, further comprising a first attachment post extending downwardly from the mounting plate, a second attachment post extending downwardly from the mounting plate in spaced relation to the first attachment post, a first locking member supported for movement along the first attachment post for securing the mounting plate to the mounting deck, and a second locking member supported for movement along the second attachment post for securing the mounting plate to the mounting deck.

11. A faucet assembly configured to be mounted to a support defining an inner side and an outer side, the faucet assembly comprising:

a body assembly including a delivery spout, a hot water inlet conduit having opposing first and second ends, the second end of the hot water inlet conduit being in fluid communication with the delivery spout, and a cold water inlet conduit having opposing first and second ends, the second end of the cold water inlet conduit being in fluid communication with the delivery spout;

a mounting plate adapted to be removably coupled to the support, the mounting plate including a flange;

the body assembly including a bracket having a cam slot configured to slidably receive the flange of the mounting plate;

a locking mechanism including a lock bushing supported for movement relative to the mounting plate between lowered and raised positions, the lock bushing in the raised position configured to secure the body assembly and prevent sliding movement of the cam slot relative to the flange;

a hot water supply assembly including a conduit and a quick release fluid coupling configured to releasably couple to the first end of the hot water inlet conduit;

the hot water quick release coupling being supported for movement between a hidden position on the inner side of the support, and an exposed position on the outer side of the support;

a cold water supply conduit assembly including a conduit and a quick release fluid coupling configured to releasably couple to the first end of the cold water inlet conduit;

the cold water quick release coupling being supported for movement between a hidden position on the inner side of the support, and an exposed position on the outer side of the support; and wherein the body assembly is configured to be mechanically coupled to and uncoupled from the support entirely from the outer side of the support, and is configured to be fluidly coupled to and uncoupled from the hot water quick release fluid coupling and the cold water quick release fluid coupling from either the inner side or the outer side of the support.

12. The faucet assembly of claim 11, wherein the body assembly further includes a housing having a lift rod passageway; and a lift rod configured to be received within the lift rod passageway, the lock bushing being accessible through the lift rod passageway.

13. The faucet assembly of claim 11, further comprising a lift rod, and a drain assembly including a plug moveable in response to movement of the lift rod, the lift rod configured to be coupled and uncoupled from the drain assembly entirely from above the mounting deck.

14. The faucet assembly of claim 11, wherein the body assembly further includes a delivery spout and at least one valve configured to control the flow of water to the delivery spout.

15. The faucet assembly of claim 11, wherein the hot water and cold water quick release couplings each include a valve biased in a closed position and configured to be opened by engagement with the hot water and cold water inlet conduits, respectively.

16. A faucet assembly configured to be mounted to a support having a lower surface and an upper surface, the faucet assembly comprising:

an upper faucet assembly including a delivery spout, a lift rod, and a lift rod passageway for receiving the lift rod;

a locking device configured to secure the upper faucet assembly relative to the support;

a drain assembly including a plug releasably coupled to the lift rod and configured to move in response to movement of the lift rod, the lift rod configured to be coupled and uncoupled from the drain assembly entirely from above the support;

a mounting plate adapted to be removably coupled to the support, the mounting plate including a flange;

the upper faucet assembly including a bracket having a cam slot configured to slidably receive the flange of the mounting plate; and the locking device including a lock bushing supported for movement relative to the mounting plate between lowered and raised positions, the lock bushing in the raised position configured to secure the body assembly and prevent sliding movement of the cam slot relative to the flange.

17. The faucet assembly of claim 16, wherein the upper faucet assembly includes an inlet conduit having a connection end.

18. The faucet assembly of claim 17, further comprising a quick release fluid coupling configured to releasably coupled with the connection end of the inlet conduit.

19. The faucet assembly of claim 18, wherein the quick release fluid coupling is supported for movement from a hidden position below the mounting plate and an exposed position above the mounting plate.

20. A faucet assembly comprising:

an upper faucet assembly configured to be supported by a mounting deck, the upper faucet assembly including a hot water valve, a cold water valve positioned in spaced relation to the hot water valve, a spout positioned intermediate the hot water valve and the cold water valve, a waterway including a hub fluidly coupled to the spout, a first arm extending from the hot water valve to the hub, and a second arm extending from the cold water valve to the hub, a hot water inlet water conduit fluidly coupled to the hot water valve, and a cold water inlet water conduit fluidly coupled to the cold water valve;

a first locking device configured to restrain the upper faucet assembly from movement perpendicular to the mounting deck, wherein the first locking device includes:

a mounting plate configured to be removably coupled to the mounting deck, the mounting plate including a flange; and wherein the upper faucet assembly includes a bracket having a cam slot configured to slidably receive the flange of the mounting plate; and a second locking device configured to restrain the upper faucet assembly from movement parallel to the mounting deck.

21. The faucet assembly of claim 20, wherein the second locking device includes:

a lock bushing supported for movement relative to the upper faucet assembly between lowered and raised positions; and wherein the upper faucet assembly includes a receiver configured to engage the lock bushing in the raised position.

22. The faucet assembly of claim 20, wherein the upper faucet assembly further includes a housing having a lift rod passageway; and a lift rod configured to be received within the lift rod passageway, the second locking device being accessible through the lift rod passageway.

23. The faucet assembly of claim 22, further comprising a drain assembly including a plug moveable in response to movement of the lift rod, the lift rod configured to be coupled and uncoupled from the drain assembly entirely from above the mounting deck.

24. The faucet assembly of claim 20, wherein the cam slot is defined by upper and lower surfaces, the lower surface inclined relative to the upper surface such that sliding movement of the bracket into the flange cause a camming action forcing the upper faucet assembly down and locking the upper faucet assembly in a vertical position.

* * * * *